US011557417B2

(12) United States Patent
Arai

(10) Patent No.: US 11,557,417 B2
(45) Date of Patent: Jan. 17, 2023

(54) COIL COMPONENT

(71) Applicant: TAIYO YUDEN CO., LTD., Tokyo (JP)

(72) Inventor: Takayuki Arai, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 342 days.

(21) Appl. No.: 17/003,158

(22) Filed: Aug. 26, 2020

(65) Prior Publication Data

US 2021/0065951 A1 Mar. 4, 2021

(30) Foreign Application Priority Data

Aug. 30, 2019 (JP) ..... JP2019-158107

(51) Int. Cl.

| | |
|---|---|
| ***H01F 17/00*** | (2006.01) |
| ***H01F 5/00*** | (2006.01) |
| ***H01F 27/28*** | (2006.01) |
| ***H01F 27/29*** | (2006.01) |

(52) U.S. Cl.

CPC ..... *H01F 17/0013* (2013.01); *H01F 5/003* (2013.01); *H01F 27/2866* (2013.01); *H01F 27/292* (2013.01); *H01F 2017/0073* (2013.01)

(58) Field of Classification Search

CPC .. H01F 17/0013; H01F 5/003; H01F 27/2866; H01F 27/292; H01F 2017/0073

See application file for complete search history.

(56) References Cited

U.S. PATENT DOCUMENTS

| | | | | |
|---|---|---|---|---|
| 6,169,470 | B1 * | 1/2001 | Ibata | H01F 17/0006 336/200 |
| 2009/0116168 | A1 * | 5/2009 | Block | H01C 7/18 361/309 |
| 2013/0093558 | A1 * | 4/2013 | Ono | H01G 2/065 336/200 |
| 2014/0078643 | A1 * | 3/2014 | Odahara | H01F 17/0013 156/89.12 |
| 2014/0292466 | A1 * | 10/2014 | Watanabe | H01F 27/29 205/118 |

(Continued)

FOREIGN PATENT DOCUMENTS

| | | | |
|---|---|---|---|
| JP | 2015-039026 | A | 2/2015 |
| WO | 2011/155241 | A1 | 12/2011 |

*Primary Examiner* — Mang Tin Bik Lian
*Assistant Examiner* — Malcolm Barnes
(74) *Attorney, Agent, or Firm* — Pillsbury Winthrop Shaw Pittman, LLP

(57) ABSTRACT

A coil component according to one embodiment of the present invention includes: a base body having a plurality of magnetic layers; a first external electrode provided on the base body; a second external electrode provided on the base body and spaced from the first external electrode; a coil conductor provided in the base body; a first lead-out conductor including a first lead-out conductor first pattern and a first lead-out conductor second pattern; and a second lead-out conductor connecting a second end of the coil conductor and the second external electrode. The first lead-out conductor first pattern is provided between the magnetic layers so as to be connected to a first end of the coil conductor and the first external electrode. The first lead-out conductor second pattern is provided between the magnetic layers so as to be connected to the first lead-out conductor first pattern and the first external electrode.

11 Claims, 17 Drawing Sheets

(56) References Cited

U.S. PATENT DOCUMENTS

| | | | | |
|---|---|---|---|---|
| 2016/0049253 | A1* | 2/2016 | Mukobata | H01G 4/232<br>361/301.4 |
| 2016/0155556 | A1* | 6/2016 | Ohkubo | H01F 41/046<br>336/83 |
| 2018/0326636 | A1* | 11/2018 | Zschoke | B29C 45/1459 |
| 2018/0342341 | A1* | 11/2018 | Aoki | H01G 4/30 |
| 2019/0214187 | A1* | 7/2019 | Imada | H01F 41/043 |
| 2019/0252781 | A1* | 8/2019 | Isayama | H01F 27/292 |
| 2020/0027650 | A1* | 1/2020 | Ryu | H01F 17/0013 |
| 2021/0043371 | A1* | 2/2021 | Shimoda | H01F 27/02 |

* cited by examiner

COIL COMPONENT

CROSS-REFERENCE TO RELATED APPLICATIONS

This application is based on and claims the benefit of priority from Japanese Patent Application Serial No. 2019-158107 (filed on Aug. 30, 2019), the contents of which are hereby incorporated by reference in their entirety.

TECHNICAL FIELD

The present invention relates to a coil component.

BACKGROUND

Various coil components have been known. One of well-known coil components is an inductor. An inductor is a passive element used in an electronic circuit. For example, an inductor eliminates noise in a power source line or a signal line. A conventional coil component includes a main body formed of a magnetic material, a coil conductor disposed in the main body, and a plurality of external electrodes disposed on the surface of the main body. The plurality of external electrodes are connected to each other via the coil conductor and lead-out conductors. The main body of the coil component is formed of ferrite, a composite resin material containing soft magnetic metal particles, or any other known magnetic material. Conventional coil components are disclosed in, for example, International Publication No. WO 2011/155241 and Japanese Patent Application Publication No. 2015-039026.

In a conventional coil component, an external electrode may fall off the main body if the joint strength between the base body and the external electrode is insufficient. For example, the external electrodes may fall off the main body when the coil component is being mounted on a circuit board. In addition, the external electrode may fall off the main body due to the impact imparted when the coil component is dropped.

Currently noted magnetic materials for the main body of the coil component are composite magnetic materials containing soft magnetic metal particles. Since such composite magnetic materials have a higher density than ferrite, a coil component with a main body containing soft magnetic metal particles tend to have a larger weight. The larger weight of the coil component produces a larger force imparted on the external electrodes when the coil component is mounted or dropped, causing the external electrodes to fall off the main body.

SUMMARY

An object of the present invention is to solve or relieve at least a part of the above problem. In particular, an object of the present invention is to inhibit the external electrodes from falling off the main body of the coil component. Other objects of the present invention will be apparent with reference to the entire description in this specification.

A coil component according to one embodiment of the present invention comprises: a base body having a plurality of magnetic layers including a first magnetic layer, a second magnetic layer, and a third magnetic layer; a first external electrode provided on a surface of the base body; a second external electrode provided on the surface of the base body, the second external electrode being spaced from the first external electrode; a coil conductor provided in the base body; a first lead-out conductor including a first lead-out conductor first pattern and a first lead-out conductor second pattern; and a second lead-out conductor connecting a second end of the coil conductor and the second external electrode. The first lead-out conductor first pattern is provided between the first magnetic layer and the second magnetic layer so as to be connected to a first end of the coil conductor and the first external electrode. The first lead-out conductor second pattern is provided between the second magnetic layer and the third magnetic layer so as to be connected to the first lead-out conductor first pattern and the first external electrode. In the embodiment, the first magnetic layer, the second magnetic layer, and the third magnetic layer project from a first contact surface and a second contact surface toward an outside of the base body, the first contact surface being a surface at which the first external electrode and the first lead-out conductor first pattern contact with each other, the second contact surface being a surface at which the first external electrode and the first lead-out conductor second pattern contact with each other.

In one embodiment of the present invention, the plurality of magnetic layers further include a fourth magnetic layer, a fifth magnetic layer, and a sixth magnetic layer. In one embodiment of the present invention, the second lead-out conductor includes a second lead-out conductor first pattern and a second lead-out conductor second pattern, the second lead-out conductor first pattern being provided between the fourth magnetic layer and the fifth magnetic layer so as to be connected to the second end of the coil conductor and the second external electrode, the second lead-out conductor second pattern being provided between the fifth magnetic layer and the sixth magnetic layer so as to be connected to the second lead-out conductor first pattern and the second external electrode. In one embodiment of the present invention, the fourth magnetic layer, the fifth magnetic layer, and the sixth magnetic layer project from a third contact surface and a fourth contact surface toward the outside of the base body, the third contact surface being a surface at which the second external electrode and the second lead-out conductor first pattern contact with each other, the fourth contact surface being a surface at which the second external electrode and the second lead-out conductor second pattern contact with each other.

In one embodiment of the present invention, the surface of the base body includes a first region and a second region, the first region being a region in which the first lead-out conductor is exposed, the second region projecting from the first region toward the outside of the base body. In one embodiment of the present invention, the first external electrode covers at least a part of the first region. In one embodiment of the present invention, the first external electrode is provided on the surface so as to cover at least a part of the first region and at least a part of the second region.

In one embodiment of the present invention, the first external electrode and the second external electrode are connected to a circuit board, In one embodiment of the present invention, the surface of the base body includes a mounting surface facing the circuit board, and the first region and the second region are regions in the mounting surface.

In one embodiment of the present invention, the first external electrode and the second external electrode are connected to a circuit board, In one embodiment of the present invention, the surface of the base body includes a first end surface and a second end surface both connected to the mounting surface facing the circuit board, the first end surface includes a third region in which the first lead-out conductor is exposed, and the second end surface includes a fourth region in which the second lead-out conductor is exposed. In one embodiment of the present invention, the first external electrode is provided on the surface so as to further cover at least a part of the third region, and the second external electrode is provided on the surface so as to further cover at least a part of the fourth region.

In one embodiment of the present invention, a thickness of each of the first magnetic layer, the second magnetic layer, and the third magnetic layer is smaller than a thickness of the first lead-out conductor first pattern and a thickness of the first lead-out conductor second pattern.

A coil component according to one embodiment of the present invention further comprises: a first independent conductor disposed in the base body so as to be spaced from the coil conductor, the first lead-out conductor, and the second lead-out conductor, the first independent conductor contacting with the first external electrode at a fifth surface, In one embodiment, the first independent conductor is provided on a first independent magnetic layer included in the plurality of magnetic layers, the first independent magnetic layer being different from the first magnetic layer, the second magnetic layer, and the third magnetic layer, and the first independent magnetic layer projects from the fifth contact surface toward the outside of the base body. A coil component according to one embodiment of the present invention further comprises: a second independent conductor disposed in the base body so as to be spaced from the coil conductor, the first lead-out conductor, and the second lead-out conductor, the second independent conductor contacting with the second external electrode at a sixth contact surface, In one embodiment, the second independent conductor is provided on the first independent magnetic layer, and the first independent magnetic layer projects from the sixth contact surface toward the outside of the base body.

An embodiment of the present invention relates to a circuit board comprising any one of the above coil components.

An embodiment of the present invention relates to an electronic device comprising the above circuit board.

Advantageous Effects

In a coil component according to one embodiment of the present invention, the external electrodes can be inhibited from falling off the main body.

DESCRIPTION OF THE EMBODIMENTS

Figure 1:
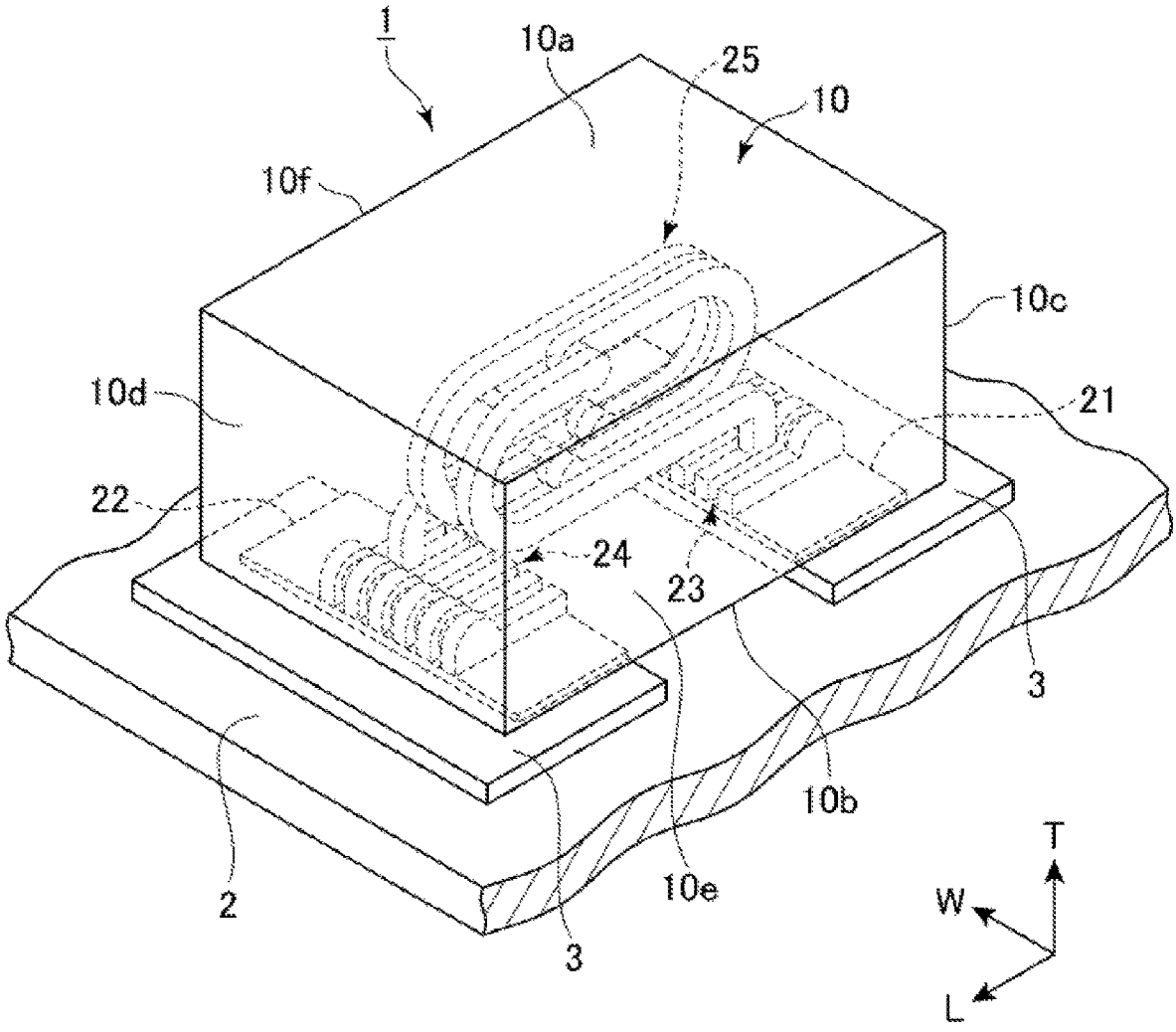
FIG. 1 is a perspective view of a coil component according to one embodiment of the invention mounted on a circuit board.
Figure 2:
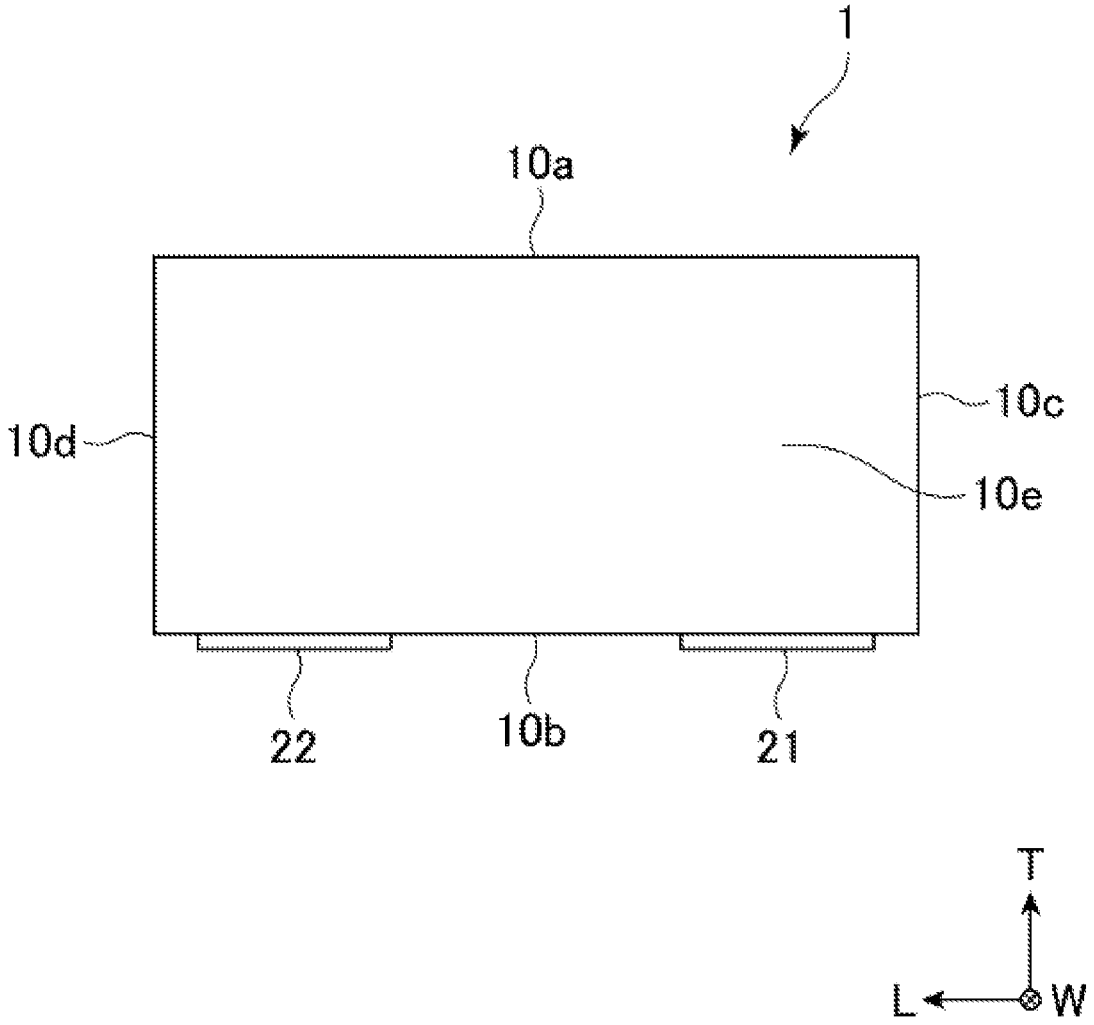
FIG. 2 is a front view of the coil component of FIG. 1.

A coil component 1 according to one embodiment of the present invention will be hereinafter described with reference to FIGS. 1 to 5B. First, with reference to FIGS. 1 and 2, an outline is given of the coil component 1. FIG. 1 is a perspective view of the coil component 1 according to one embodiment of the present invention, and FIG. 2 is a front view of the coil component 1. As shown, the coil component 1 includes a base body 10, a coil conductor 25 disposed in the base body 10, an external electrode 21 disposed on the surface of the base body 10, an external electrode 22 disposed on the surface of the base body 10 at a position spaced from the external electrode 21, a lead-out conductor 23 electrically connecting one end of the coil conductor 25 and the external electrode 21, and a lead-out conductor 24 electrically connecting the other end of the coil conductor 25 and the external electrode 22.

Each of the drawings shows the L axis, the W axis, and the T axis orthogonal to one another. In this specification, a "length" direction, a "width" direction, and a "thickness" direction of the coil component 1 refer to the direction along the L axis, the direction along the W axis, and the direction along the T axis in FIG. 1, respectively, unless otherwise construed from the context.

The coil component 1 is mounted on a circuit board 2. The circuit board 2 has two land portions 3 provided thereon. The coil component 1 may be mounted on the circuit board 2 by soldering the external electrodes 21, 22 to the corresponding land portions 3 of the circuit board 2. The circuit board 2 can be installed in various electronic devices. Electronic devices in which the circuit board 2 may be installed include smartphones, tablets, game consoles, and various other electronic devices.

The coil component 1 is an example coil component to which the present invention is applicable. The invention may be applied to inductors, transformers, filters, reactors, and various other coil components. The invention may be also applied to coupled inductors, choke coils, and any other magnetically coupled coil components.

The base body 10 is made of a magnetic material and formed in a rectangular parallelepiped shape. In one embodiment of the invention, the base body 10 has a length (the dimension in the L axis direction) of 1.0 to 10.0 mm, a width (the dimension in the W axis direction) of 0.5 to 10.0 mm, and a thickness (the dimension in the T axis direction) of 0.8 to 5.0 mm. For example, the base body 10 has a length of 3.2 mm, a width of 2.5 mm, and a thickness of 2.5 mm. The dimensions of the base body 10 are not limited to those specified herein. The term "rectangular parallelepiped" or "rectangular parallelepiped shape" used herein is not intended to mean solely "rectangular parallelepiped" in a mathematically strict sense.

The base body 10 has a first principal surface 10*a*, a second principal surface 10*b*, a first end surface 10*c*, a second end surface 10*d*, a first side surface 10*e*, and a second side surface 10*f*. The outer surface of the base body 10 is defined by these six surfaces. The first principal surface 10*a* and the second principal surface 10*b* are opposed to each other, the first end surface 10*c* and the second end surface 10*d* are opposed to each other, and the first side surface 10*e* and the second side surface 10*f* are opposed to each other. Based on the position of the circuit board 2, the first principal surface 10*a* lies on the top side of the base body 10, and therefore, the first principal surface 10*a* may be herein referred to as "the top surface." Similarly, the second principal surface 10*b* may be referred to as "the bottom surface." The coil component 1 is disposed such that the second principal surface 10*b* faces the circuit board 2, and therefore, the second principal surface 10*b* may be herein referred to as "the mounting surface" or "the mounting surface 10*b*." The top-bottom direction of the coil component 1 refers to the top-bottom direction in FIG. 1.

In the embodiment shown, the external electrode 21 and the external electrode 22 are provided on the mounting surface 10*b* of the base body 10. It is also possible that the external electrodes 21 and 22 are provided on a surface of the base body 10 other than the mounting surface 10*b*.

The base body 10 is made of a magnetic material. The magnetic material for the base body 10 may contain a plurality of soft magnetic metal particles. The soft magnetic metal particles contained in the magnetic material for the base body 10 are, for example, particles of (1) a metal such as Fe or Ni, (2) a crystalline alloy such as an Fe—Si—Cr alloy, an Fe—Si—Al alloy, or an Fe—Ni alloy, (3) an amorphous alloy such as an Fe—Si—Cr—B—C alloy or an Fe—Si—Cr—B alloy, or (4) a mixture thereof. The composition of the soft magnetic metal particles contained in the base body 10 is not limited to those described above. For example, the soft magnetic metal particles contained in the base body 10 may be particles of a Co—Nb—Zr alloy, an Fe—Zr—Cu—B alloy, an Fe—Si—B alloy, an Fe—Co—Zr—Cu—B alloy, an Ni—Si—B alloy, or an Fe—Al—Cr alloy. An insulating film may be provided on a surface of each of the soft magnetic metal particles. The insulating film may be an oxide film made of an oxide of the above metals or alloys. The insulating film provided on the surface of each of the soft magnetic metal particles may be a silicon oxide film provided by the sol-gel coating process. The insulating film provided on the surface of each of the soft magnetic metal particles may contain Bi.

In one embodiment, the soft magnetic metal particles have an average particle size of 1.5 to 20 μm. The average particle size of the soft magnetic metal particles contained in the base body 10 may be smaller than 1.5 μm or larger than 20 μm. The base body 10 may contain two or more types of soft magnetic metal particles having different average particle sizes. For example, the soft magnetic metal particles for the composite magnetic material may include first soft magnetic metal particles having a first average particle size and second soft magnetic metal particles having a second average particle size smaller than the first average particle size. In one embodiment, the base body 10 may further contain third soft magnetic metal particles having a third average particle size smaller than the second average particle size. The average particle size of the soft magnetic metal particles contained in the base body 10 is determined based on the particle size distribution. To determine the particle size distribution, the base body 10 is cut along the thickness direction (T direction) to expose a section, and the section is scanned by a scanning electron microscope (SEM) to take photographs at a 2000 to 5000-fold magnification for particles 1 μm or larger and at a 5000 to 10000-fold magnification for particles smaller than 1 μm, and the particle size distribution is determined based on the photographs. For example, the value at 50 percent of the particle size distribution determined based on the SEM photographs can be set as the average particle size of the soft magnetic metal particles.

The base body 10 may be formed of a composite magnetic material containing the soft magnetic metal particles and a binder. When the base body 10 is formed of the composite magnetic material, the binder included in the composite magnetic material is, for example, a thermosetting resin with excellent insulation properties. Examples of the binder include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin.

The base body 10 may have two or more regions made of different magnetic materials. For example, the magnetic layer 11*a* and the magnetic layer 11*b* may be formed of different magnetic materials from each other.

Figure 3:
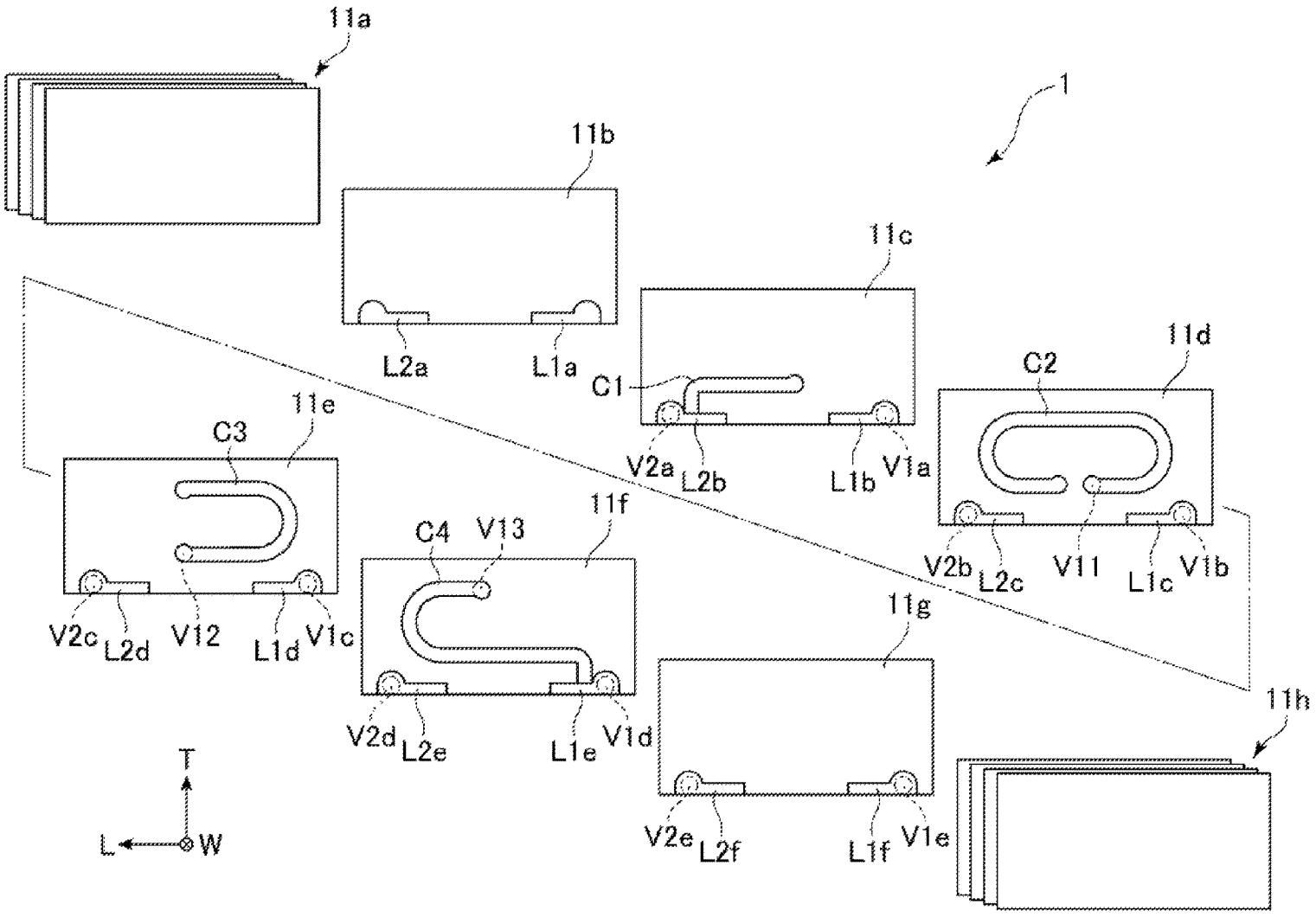
FIG. 3 is an exploded view of the coil component of FIG. 1.

Next, with further reference to FIG. 3, a description is given of the lamination structure of the coil component 1 formed by a lamination process. In FIG. 3, the external electrodes 21, 22 are not shown for convenience of description. FIG. 3 is an exploded view of the coil component 1. As shown in FIG. 3, the base body 10 includes magnetic layers 11*a* to 11*h*. Each of the magnetic layers 11*a* to 11*h* is made of a magnetic material. The base body 10 includes the magnetic layer 11*a*, the magnetic layer 11*b*, the magnetic layer 11*c*, the magnetic layer 11*d*, the magnetic layer 11*e*, the magnetic layer 11*f*, the magnetic layer 11*g*, and the magnetic layer 11*h*, which are stacked together in the stated order from the positive side to the negative side in the W-axis direction. The magnetic layer 11*a* and the magnetic layer 11*h* are disposed at the opposite ends of the lamination structure in the W-axis direction. As shown, the magnetic layer 11*a* and the magnetic layer 11*h* may each include a plurality of magnetic layers. The magnetic layer 11*a* and the magnetic layer 11*h* are disposed so as to cover the coil conductor 25 on both sides in the W-axis direction, and thus these magnetic layers may be referred to as the cover layers. The magnetic layer 11*a* and the magnetic layer 11*h* may be herein referred to as the cover layer 11*a* and the cover layer 11*h*, respectively. The coil component 1 may be formed by a technique other than the lamination process. For example, the coil component 1 may be alternatively formed by the thin film process.

The magnetic layers 11*c* to 11*f* have coil patterns C1 to C4, respectively, disposed on one surface thereof, and the magnetic layers 11*b* to 11*g* have lead-out conductor patterns L1*a* to L1*f* and lead-out conductor patterns L2*a* to L2*f*, respectively, disposed on one surface thereof. In the illustrated embodiment, the magnetic layers 11*c* to 11*f* have the coil conductor patterns C1 to C4, and the magnetic layers 11*b* to 11*g* have the lead-out conductor patterns L1*a* to L1*f* and the lead-out conductor patterns L2*a* to L2*f* disposed on the negative side surfaces thereof in the W-axis direction, among the pairs of surfaces thereof intersecting the W-axis direction. The coil conductor patterns C1 to C4, the lead-out conductor patterns L1*a* to L1*f*, and the lead-out conductor patterns L2*a* to L2*f* are formed by, for example, printing a conductive paste made of a highly conductive metal or alloy via screen printing. The conductive paste may be made of Ag, Pd, Cu, Al, or alloys thereof. The coil conductor patterns C1 to C4 may be formed using other methods and materials. For example, the coil conductor patterns C1 to C4 may be formed by sputtering, ink-jetting, or other known methods.

The magnetic layers 11*d* to 11*f* are provided with vias V11 to V13, respectively, at a predetermined position therein, and the magnetic layers 11*c* to 11*g* are provided with vias Via to Vie and vias V2*a* to V2*e*, respectively, at a predetermined position therein. The vias V11 to V13 are formed by forming a through-hole at the respective predetermined position in the magnetic layers 11*d* to 11*f* so as to extend through the magnetic layers 11*d* to 11*f* in the W axis direction and filling the through-holes with a conductive paste. The vias Via to Vie and the vias V2*a* to V2*e* are formed by forming a through-hole at the respective predetermined position in the magnetic layers 11*c* to 11*g* so as to extend through the magnetic layers 11*c* to 11*g* in the W axis direction and filling the through-holes with a conductive paste.

Adjacent ones of the coil conductor patterns C1 to C4 are electrically connected to each other through one of the vias V11 to V13. The coil conductor patterns C1 to C4 and the vias V11 to V13 connected together in this manner form the spiral coil conductor 25. In other words, the coil conductor 25 is constituted by the coil conductor patterns C1 to C4 and the vias V11 to V13.

One end of the coil conductor pattern C1 is connected to the via V11, and the other end of the coil conductor pattern C1 is connected to the lead-out conductor pattern L2*b*. One end of the coil conductor pattern C4 is connected to the via V13, and the other end of the coil conductor pattern C4 is connected to the lead-out conductor pattern Lie. In other words, the coil conductor 25 is connected at one end thereof to the lead-out conductor 23 and at the other end thereof to the lead-out conductor 24. As described above, the lead-out conductor 23 electrically connects between one end of the coil conductor 25 and the external electrode 21, and the lead-out conductor 24 electrically connects between the other end of the coil conductor 25 and the external electrode 22.

Adjacent ones of the lead-out conductor patterns L1*a* to L1*f* are electrically connected to each other through one of the vias V1*a* to Vie, and adjacent ones of the lead-out conductor patterns L2*a* to L2*f* are electrically connected to each other through one of the vias V2*a* to V2*e*. In this way, the lead-out conductor patterns L1*a* to L1*f* and the vias V1*a* to Vie connected together constitute the lead-out conductor 23, and the lead-out conductor patterns L2*a* to L2*f* and the vias V2*a* to V2*e* connected together constitute the lead-out conductor 24. In other words, the lead-out conductor 23 includes the lead-out conductor patterns L1*a* to L1*f* and the vias V1*a* to Vie, and the lead-out conductor 24 includes the lead-out conductor patterns L2*a* to L2*f* and the vias V2*a* to V2*e*.

Figure 4:
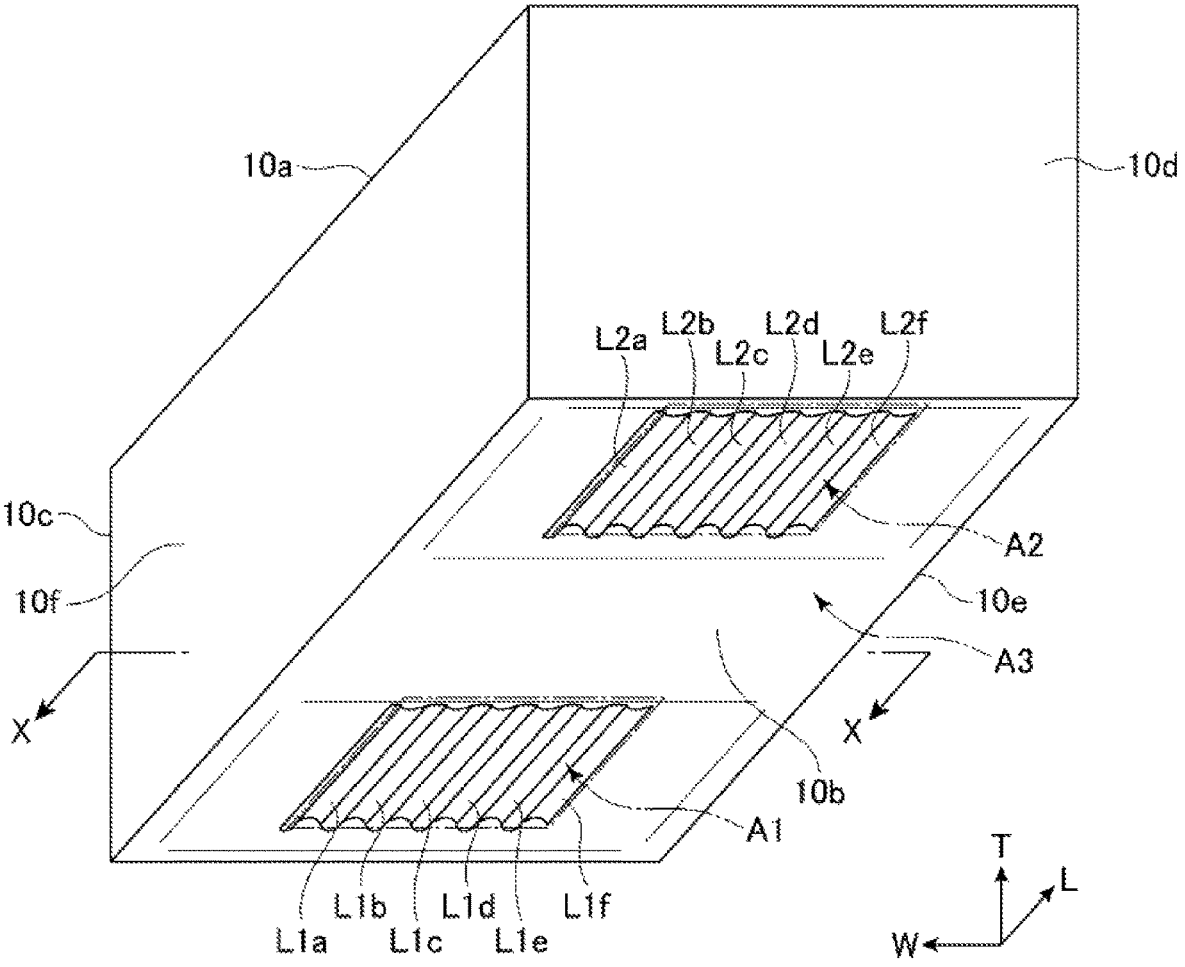
FIG. 4 is a perspective view of the coil component of FIG. 1 as viewed from a mounting surface side.

As shown in FIG. 4, the lead-out conductor patterns L1*a* to L1*f* and the lead-out conductor patterns L2*a* to L2*f* are disposed so as to be exposed from the surface of the base body 10. In the embodiment shown in FIG. 4, the lead-out conductor patterns L1*a* to L1*f* and the lead-out conductor patterns L2*a* to L2*f* are disposed so as to be exposed at respective lower ends thereof from the mounting surface 10*b* of the base body 10. The mounting surface 10*b* of the base body 10 includes a first exposure region A1 in which the lead-out conductor patterns Lia to L1*f* are exposed, a second exposure region A2 in which the lead-out conductor patterns L2*a* to L2*f* are exposed, and a non-exposure region A3 other than the first exposure region A1 and the second exposure region A2.

The external electrode 21 covers at least a part of the first exposure region A1. The external electrode 21 may alternatively cover the whole of the first exposure region A1. The external electrode 21 is connected to each of the lead-out conductor patterns L1*a* to L1*f*. The external electrode 22 covers at least a part of the second exposure region A2. The external electrode 22 may alternatively cover the whole of the second exposure region A2. The external electrode 22 is connected to a part or all of the lead-out conductor patterns L2*a* to L2*f*. In this way, the lead-out conductor patterns L1*a* to L1*f* are connected to the external electrode 21, and the lead-out conductor patterns L2*a* to L2*f* are connected to the external electrode 22.

Figure 5A:
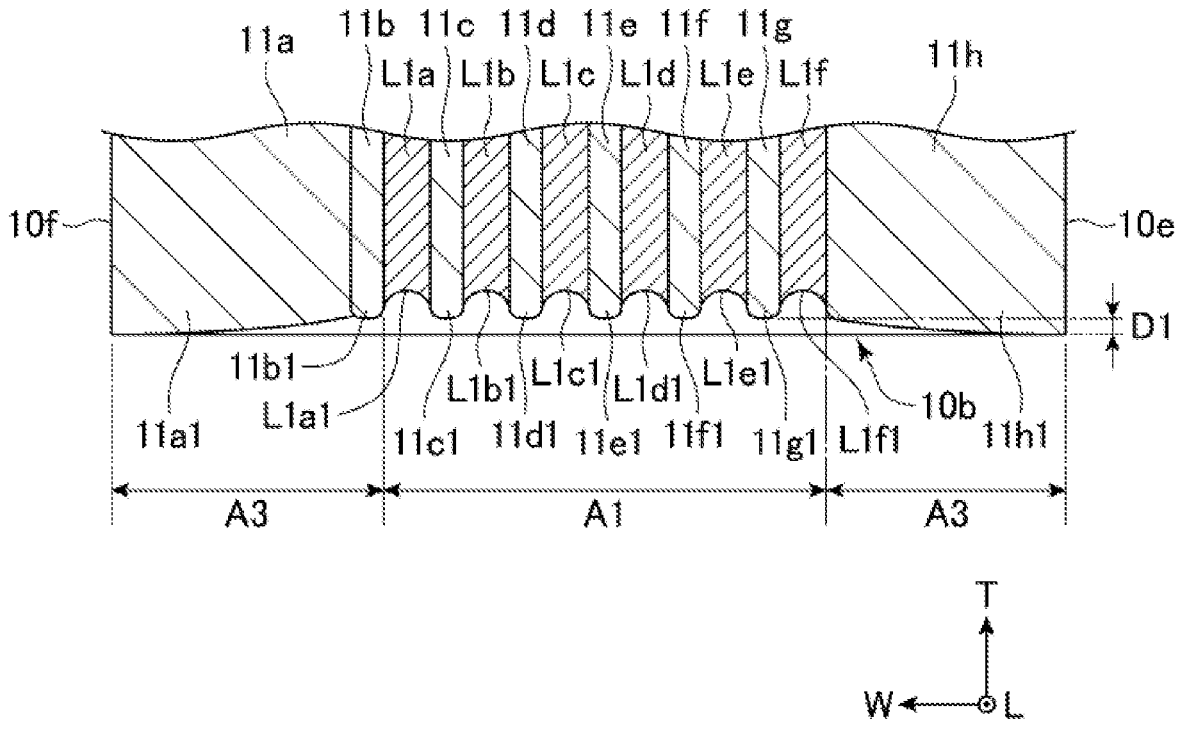
FIG. 5A schematically illustrates a part of a cross section of the coil component of FIG. 1 cut along the line X-X.
Figure 5B:
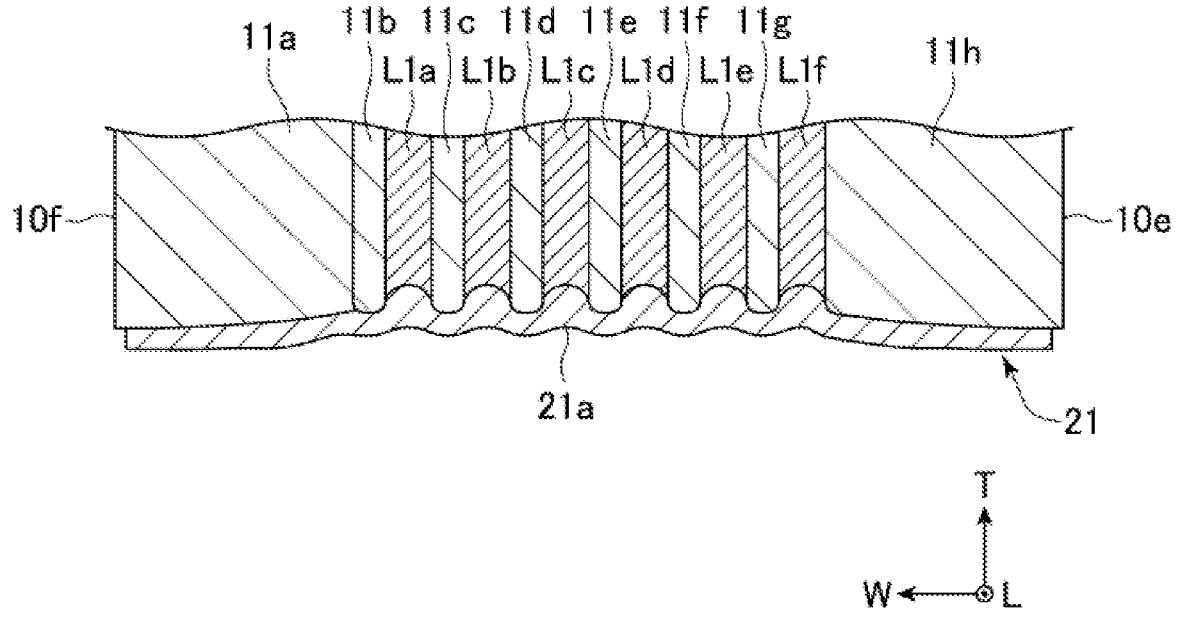
FIG. 5B schematically illustrates a cross section of the coil component of FIG. 1 cut along the line X-X.

Next, a description is given of the first exposure region A1 in the mounting surface 10*b* with reference to FIGS. 5A and 5B. FIGS. 5A and 5B are cross-sectional views of the coil component 1 cut along the line X-X. In other words, FIGS. 5A and 5B show a cross section of the coil component 1 cut along a WT plane extending through the first exposure region A1. In FIG. 5A, the external electrode 21 is not shown for convenience of description.

As clearly shown in FIGS. 5A and 5B, each of the lead-out conductor patterns L1*a* to L1*f* is disposed between two adjacent magnetic layers among the magnetic layers 11*b* to 11*h*. For example, the lead-out conductor pattern L1*e* is disposed between the magnetic layer 11*f* and the magnetic layer 11*g*. Likewise, the lead-out conductor pattern Ltd, which is adjacent to the lead-out conductor pattern L1*e* and connected to the lead-out conductor pattern L1*e* through the via V1*d*, is disposed between the magnetic layer 11*e* and the magnetic layer 11*f*. The other lead-out conductor patterns included in the lead-out conductor patterns L1*a* to L1*f* are disposed in the same manner. Although not shown in FIGS. 5A and 5B, each of the lead-out conductor patterns L2*a* to L2*f* is also disposed between two adjacent magnetic layers among the magnetic layers 11*b* to 11*h*, in the same manner as the lead-out conductor patterns L1*a* to L1*f*.

In the embodiment shown, the thickness (the dimension in the W axis direction) of each of the magnetic layers 11*b* to 11*g* is smaller than the thickness (the dimension in the W axis direction) of each of the lead-out conductor patterns L1*a* to L1*f*. This reduces resistances of the lead-out conductor 23 and the lead-out conductor 24. The thickness of each of the lead-out conductor patterns Lia to L1*f* may be equal to or larger than two, three, four, five, or ten times as large as the thickness of each of the magnetic layers 11*b* to 11*g*.

The lead-out conductor patterns L1*a* to L1*f* are disposed such that the respective end surfaces L1*a*1 to L1*f*1 thereof are exposed from the mounting surface 10*b* of the base body 10. In other words, the respective end surfaces L1*a*1 to L1*f*1 of the lead-out conductor patterns Lia to L1*f* are exposed from the mounting surface 10*b* of the base body 10 to the outside of the base body 10. As will be described later, the respective end surfaces L1*a*1 to L1*f*1 of the lead-out conductor patterns Lia to L1*f* are polished, and therefore, each of the end surfaces L1*a*1 to L1*f*1 are concave toward the inside of the base body 10 (in the positive direction of the T axis). As shown in FIG. 5B, the external electrode 21 is mounted on the mounting surface 10*b*. Therefore, the respective end surfaces L1*a*1 to L1*f*1 of the lead-out conductor patterns L1*a* to L1*f* are covered by the external electrode 21. Accordingly, although the respective end surfaces L1*a*1 to L1*f*1 of the lead-out conductor patterns Lia to L1*f* are exposed from the base body 10 to the outside, the lead-out conductor patterns L1*a* to L1*f* and the respective end surfaces L1*a*1 to L1*f*1 thereof are not exposed to the atmosphere. The external electrode 21 contacts with the end surfaces L1*a*1 to L1*f*1 of the lead-out conductor patterns L1*a* to L1*f*. Since the end surfaces L1*a*1 to L1*f*1 of the lead-out conductor patterns L1*a* to L1*f* contact with the external electrode 21, the end surfaces L1*a*1 to L1*f*1 may be herein referred to as the contact surfaces L1*a*1 to L1*f*1.

As shown, the magnetic layers 11*a* to 11*h* project from the contact surfaces L1*a*1 to L1*f*1 of the lead-out conductor patterns L1*a* to L1*f* toward the outside of the base body 10. In the embodiment shown, the magnetic layers 11*a* to 11*h* project from the contact surfaces L1*a*1 to L1*f*1 in the negative direction of the T axis. The magnetic layers 11*b* to 11*g* have respective projections 11*b*1 to 11*g*1 projecting from the contact surfaces L1*a*1 to L1*f*1 toward the outside of the base body 10. The contact surfaces L1*a*1 to L1*f*1 are concaved toward the inside of the base body 10. Therefore, the contact portions of the contact surfaces L1*a*1 to L1*f*1 each contacting with adjacent one of the magnetic layers 11*a* to 11*h* are at the outermost positions (on the negative side in the T axis direction) within the base body 10. The magnetic layers 11*a* to 11*h* project toward the outside of the base body 10 beyond the contact portions of the contact surfaces L1*a*1 to L1*f*1 that are at the outermost positions within the base body 10. Although not shown, the relationship between the magnetic layers 11*a* to 11*h* and the lead-out conductor patterns L2*a* to L2*f* is the same as the relationship between the magnetic layers 11*a* to 11*h* and the lead-out conductor patterns L1*a* to L1*f* shown in FIG. 5A. More specifically, the magnetic layers 11*a* to 11*h* project from the end surfaces of the lead-out conductor patterns L2*a* to L2*f* toward the outside of the base body 10. The respective end surfaces of the lead-out conductor patterns L2*a* to L2*f* are contact surfaces at which the lead-out conductor patterns L2*a* to L2*f* contact with the external electrode. In this way, the magnetic layers 11*b* to 11*g* have the projections 11*b*1 to 11*g*1 that project from the end surfaces of the lead-out conductor patterns L1*a* to L1*f* and the lead-out conductor patterns L2*a* to L2*f* toward the outside of the base body 10, and therefore, the mounting surface 10*b* of the base body 10 has indentation in the first exposure region A1 and the second exposure region A2.

In one embodiment, the magnetic layers 11*a* to 11*h* have a higher wear resistance than the lead-out conductor patterns L1*a* to L1*f*. Therefore, the first exposure region A1 can be polished such that the end surfaces L1*a*1 to L1*f*1 of the lead-out conductor patterns L1*a* to L1*f* are concaved from the magnetic layers 11*a* to 11*h*. Likewise, the magnetic layers 11*a* to 11*h* have a higher wear resistance than the lead-out conductor patterns L2*a* to L2*f*. Therefore, the second exposure region A2 can be polished such that the end surfaces of the lead-out conductor patterns L2*a* to L2*f* are concaved from the magnetic layers 11*a* to 11*h*. The end surfaces L1*a*1 to L1*f*1 of the lead-out conductor patterns L1*a* to L1*f* may be curved. For example, each of the end surfaces L1*a*1 to L1*f*1 of the lead-out conductor patterns L1*a* to L1*f* is curved to be most deeply concaved at the middle in the W axis direction. Since the end surfaces L1*a*1 to L1*f*1 are curved, the contact area between the lead-out conductor patterns L1*a* to L1*f* and the external electrode 21 is larger. As a result, the external electrode 21 can be mounted on the lead-out conductor 23 more firmly. In each of the curved end surfaces L1*a*1 to L1*f*1 of the lead-out conductor patterns L1*a* to L1*f*, the dimension between the portion at the outermost position (on the negative side in the T axis direction) and the portion at the innermost position (on the positive side in the T axis direction) is, for example, 2 to 35 μM (this dimension is herein referred to as "amount of concavity"). The amount of concavity of the end surfaces L1*a*1 to L1*f*1 may be equal to or larger than one-twelfth, one-eleventh, one-tenth, one-ninth, one-eighth, one-seventh, or one-sixth of the thickness of the lead-out conductor patterns L1*a* to L1*f*. The above description on the end surfaces L1*a*1 to L1*f*1 of the lead-out conductor patterns L1*a* to L1*f* also applies to the end surfaces of the lead-out conductor patterns L2*a* to L2*f*.

In one embodiment, the magnetic layers 11*a* to 11*h* project, for example, by 3 to 50 μm, from the lead-out conductor patterns L1*a* to L1*f* toward the outside of the base body 10. In other words, the amount of projection of the magnetic layers 11*a* to 11*h* from the lead-out conductor patterns Lia to L1*f* is, for example, 3 to 50 μm. The presence of projections 11*b*1 to 11*g*1 enlarges the contact area in which the external electrode 21 contacts with the base body 10 and the lead-out conductor 23, thereby inhibiting the external electrode 21 from falling off. The dimension of the projections 11*b*1 to 11*g*1 in the T axis direction (this dimension is herein referred to as "amount of projection") may be equal to or larger than one-tenth, one-ninth, one-eighth, one-seventh, one-sixth, or one-fifth of the thickness (the dimension in the W axis direction) of each of the lead-out conductor patterns L1*a* to L1E The amount of projection of the magnetic layers 11*a* to 11*h* from the lead-out conductor patterns L2*a* to L2*f* may be about the same as that of the magnetic layers 11*a* to 11*h* from the lead-out conductor patterns L1*a* to L1*f*.

As described above, the magnetic layer 11*a* and the magnetic layer 11*h* each include a plurality of magnetic layers. The magnetic layer 11*a* includes a projection 11*a*1 that projects beyond the projections 11*b*1 to 11*g*1 of the magnetic layers 11*b* to 11*g* toward the outside of the base body 10, and the magnetic layer 11*h* includes a projection 11*h*1 that projects beyond the projections 11*b*1 to 11*g*1 of the magnetic layers 11*b* to 11*g* toward the outside of the base body 10. The projection 11*a*1 and the projection 11*b*1 are disposed in the non-exposure region A3 of the mounting surface 10*b*. The projection 11*a*1 and the projection 11*h*1 project by D1 in the negative direction of the T axis beyond the ends of the projections 11*b*1 to 11*g*1 of the magnetic layers 11*b* to 11*g*. The amount of projection D1 is within the range of, for example, 10 to 120 μm. The cover layer 11*a* and the cover layer 11*h* may be configured such that the amount of projection D1 is larger as the total thickness of the lead-out conductor patterns L1*a* to L1*f* is larger.

Since the external electrode 21 is disposed on the first exposure region A1 of the mounting surface 10*b*, the indentation of the first exposure region A1 is reflected in the outer surface 21*a* of the external electrode 21, as shown in FIG. 5B. In other words, the portion of the outer surface 21*a* of the external electrode 21 that faces the first exposure region A1 has indentation.

In FIG. 5A, the respective end surfaces L1*a*1 to L1*f*1 of the lead-out conductor patterns L1*a* to L1*f* are disposed at the same position in the T axis direction, but it is also possible that the positions of the end surfaces L1*a*1 to L1*f*1 are different from each other. For example, the end surface L1*a*1 may be closer or farther to the outside of the base body 10 than the end surface L1b1 is. In FIG. 5A, the ends of the projections 11b1 to 11g1 of the magnetic layers 11b to 11g are disposed at the same position in the T axis direction, but it is also possible that the positions of the ends of the projections 11b1 to 11g1 may be different from each other. For example, the projection 11b1 may be closer or farther to the outside of the base body 10 than the projection 11c1 is.

Figure 5C:
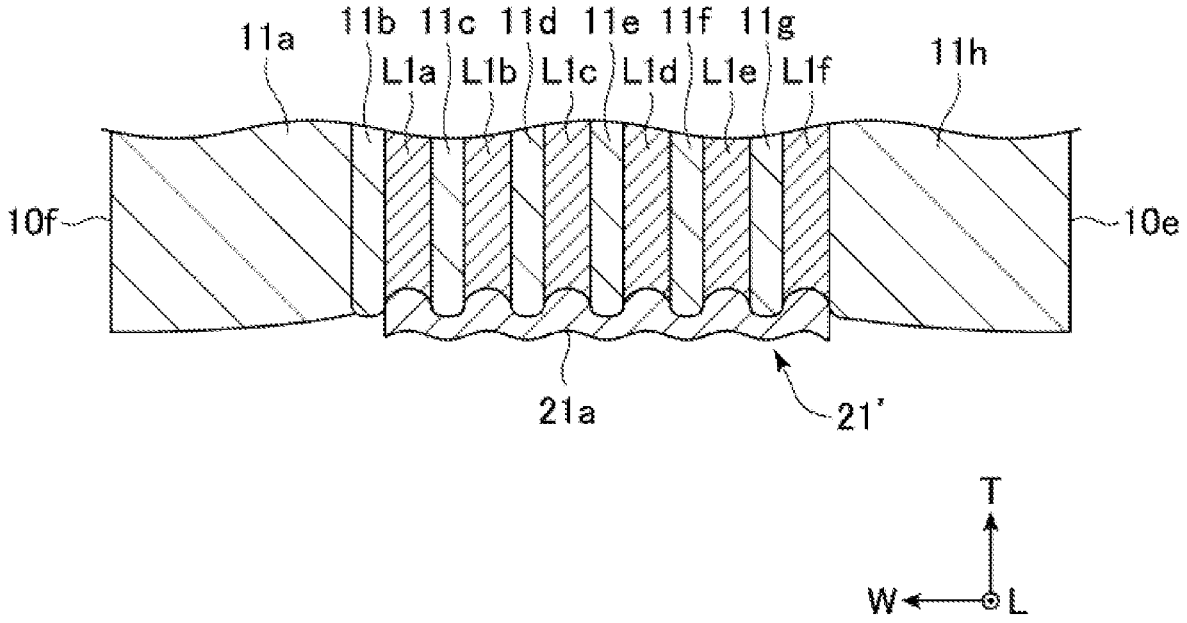
FIG. 5C schematically illustrates a cross section of the coil component 1 according to another embodiment of the present invention cut along the line X-X.

Next, another embodiment of the invention will be described with reference to FIG. 5C. In this embodiment, the shapes of the external electrodes 21, 22 are modified. FIG. 5C schematically illustrates a cross section of the coil component 1 according to the other embodiment of the present invention cut along the line X-X. The coil component 1 according to the embodiment shown in FIG. 5C includes an external electrode 21' in place of the external electrode 21. As shown, the external electrode 21' is disposed only in the first exposure region A1 in the A axis direction. The external electrode 21' may extend out of the first exposure region A1 in the positive and negative directions of the W axis direction by 10% or less of the dimension of the first exposure region A1 in the W axis direction. In other words, the aspect of the external electrode 21' being disposed only in the first exposure region A1 herein includes the aspect of the external electrode 21' extending out of the first exposure region A1 in the W axis direction by 10% or less of the dimension of the first exposure region A1. The mounting surface 10b of the base body 10 is more concave in the first exposure region A1 than in the non-exposure region A3, and therefore, when the external electrode 21' is disposed only in the first exposure region A1, the height (the dimension in the T axis direction) of the coil component 1 can be smaller. This downsizes the coil component 1. The external electrode 22' is disposed only in the second exposure region A2, as with the external electrode 21'. The aspect of the external electrode 22' being disposed only in the second exposure region A2 herein includes the aspect of the external electrode 22' extending out of the second exposure region A2 in the W axis direction by 10% or less of the dimension of the second exposure region A2.

Next, a description is given of an example of a production method of the coil component 1. The coil component 1 can be produced by, for example, a lamination process. An example is hereinafter described of the production method of the coil component 1 using the lamination process. FIG. 3 will be referred to as necessary.

The first step is to prepare a plurality of magnetic sheets made of a magnetic material. These magnetic sheets will be fired to form the magnetic layers 11a to 11h. The magnetic sheets are made of, for example, a composite magnetic material containing a binder and a plurality of soft magnetic metal particles.

Next, a through-hole is formed in each of the magnetic sheets to be the magnetic layers 11c to 11g at a predetermined position so as to extend through the magnetic sheet in the W axis direction. Next, a conductive paste is printed on the surface of each of the magnetic sheets to be the magnetic layers 11b to 11g, thereby forming unfired conductor patterns to be fired to form the coil conductor patterns C1 to C4, the lead-out conductor patterns Lia to L1f, and the lead-out conductor patterns L2a to L2f. The through-hole formed in each magnetic sheet is filled with the conductive paste. The conductive paste filled in the through-holes will be fired to form the vias V11 to V13, the vias Via to Vie, and the vias V2a to V2e. The unfired conductor patterns to be fired to form the coil conductor patterns C1 to C4 are herein referred to as unfired coil conductor patterns C1 to C4. Likewise, the conductor patterns or the conductive paste filled in the through-holes to be fired to form the lead-out conductor patterns L1a to L1f, the lead-out conductor patterns L2a to L2f, the vias V11 to V13, the vias Via to Vie, and the vias V2a to V2e are also referred to as unfired lead-out conductor patterns Lia to L1f, and so on.

Next, the magnetic sheets to be the magnetic layers 11a to 11h are stacked together to obtain a laminate. These magnetic sheets are stacked together such that the each of the unfired coil conductor patterns C1 to C4 is connected to adjacent ones of the unfired coil conductor patterns through the unfired vias V11 to V13, each of the unfired lead-out conductor patterns L1a to L1f is connected to adjacent ones of the unfired lead-out conductor patterns through the unfired vias Via to Vie, and each of the unfired lead-out conductor patterns L2a to L2f is connected to adjacent ones of the unfired lead-out conductor patterns through the unfired vias V2a to V2e.

Next, the laminate is diced using a cutter such as a dicing machine or a laser processing machine to obtain a chip laminate. Next, the chip laminate is degreased and then fired.

Next, the chip laminate is polished by barrel-polishing or the like. The medium (polishing stone) used in barrel-polishing should have a particle size smaller than the thickness (the dimension in the W axis direction) of the lead-out conductor patterns L1a to L1f and the lead-out conductor patterns L2a to L2f. In one embodiment, the medium used should have a particle size smaller than half of the thickness of the lead-out conductor patterns L1a to L1f and the lead-out conductor patterns L2a to L2f. When the thickness of the lead-out conductor pattern L1a is not uniform, the dimension thereof in the W axis direction at the end surface L1a1 may be taken as the thickness of the lead-out conductor pattern L1a. The same also applies to the lead-out conductor patterns L1b to L1f and the lead-out conductor patterns L2a to L2f. When the lead-out conductor patterns L1a to L1f and the lead-out conductor patterns L2a to L2f have different thicknesses, the medium used should have a particle size smaller than the smallest one of the thicknesses of the lead-out conductor patterns L1a to L1f and the lead-out conductor patterns L2a to L2f. As described above, the magnetic layers 11a to 11h have a higher wear resistance than the lead-out conductor patterns Lia to L1f and the lead-out conductor patterns L2a to L2f. Therefore, since the medium used in barrel-polishing has a particle size smaller than the thickness (the dimension in the W axis direction) of the lead-out conductor patterns L1a to L1f and the lead-out conductor patterns L2a to L2f, the polishing process can be performed such that the end surfaces L1a1 to L1f1 of the lead-out conductor patterns L1a to L1f are concaved from the magnetic layers 11b to 11f, as shown in FIG. 5A. Through the polishing process, an indentation can be formed in the first exposure region A1 and the second exposure region A2.

Next, the external electrode 21 and the external electrode 22 are formed on the surface of the chip laminate that corresponds to the mounting surface 10b. The external electrode 21 is provided so as to cover the first exposure region A1, and the external electrode 22 is provided so as to cover the second exposure region A2. Each of the external electrode 21 and the external electrode 22 is formed by applying a conductive paste onto the surface of the chip laminate that corresponds to the mounting surface 10b to form a base electrode and forming a plating layer on the surface of the base electrode. The plating layer is constituted by, for example, two layers including a nickel plating layer containing nickel and a tin plating layer containing tin. At least one of a solder barrier layer and a solder wetting layer may be formed on the external electrode 21 and the external electrode 22 as necessary. The coil component 1 is obtained, as described above.

A part of the steps included in the above production method may be omitted as necessary. In the production method of the coil component 1, steps not described explicitly in this specification may be performed as necessary. A part of the steps included in the production method of the coil component 1 may be performed in different order within the purport of the present invention. A part of the steps included in the production method of the coil component 1 may be performed at the same time or in parallel, if possible.

Next, with reference to FIGS. 6 to 10, a description is given of a coil component 101 according to another embodiment of the present invention. The coil component 101 is different from the coil component 1 with respect to the lead-out conductors and the external electrodes. More specifically, the coil component 101 includes an external electrode 121, an external electrode 122, a lead-out conductor 123, and a lead-out conductor 124 in place of the external electrode 21, the external electrode 22, the lead-out conductor 23, and the lead-out conductor 24 of the coil component 1.

Figure 6:
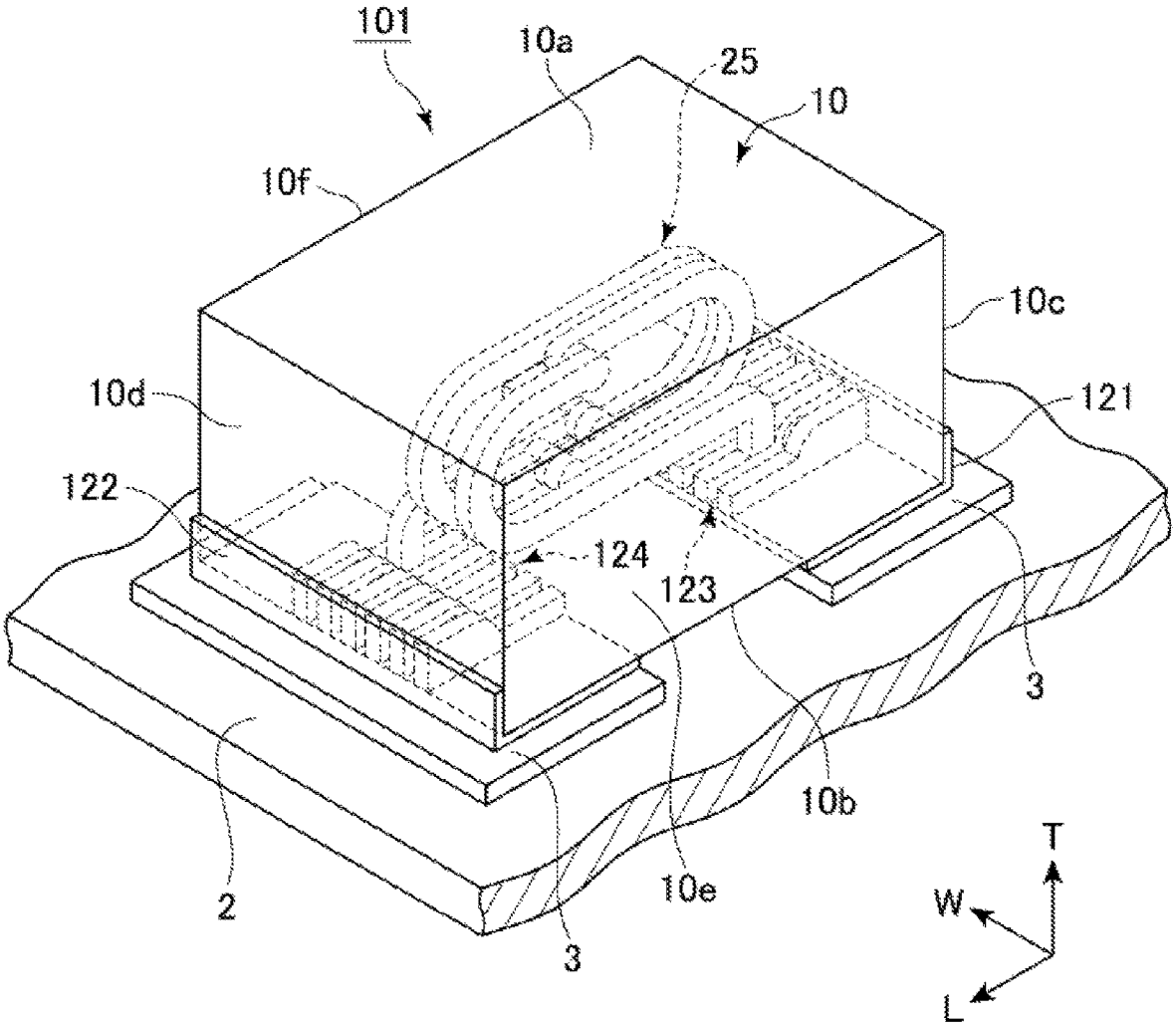
FIG. 6 is a perspective view of the coil component according to another embodiment of the invention mounted on a circuit board.
Figure 7:
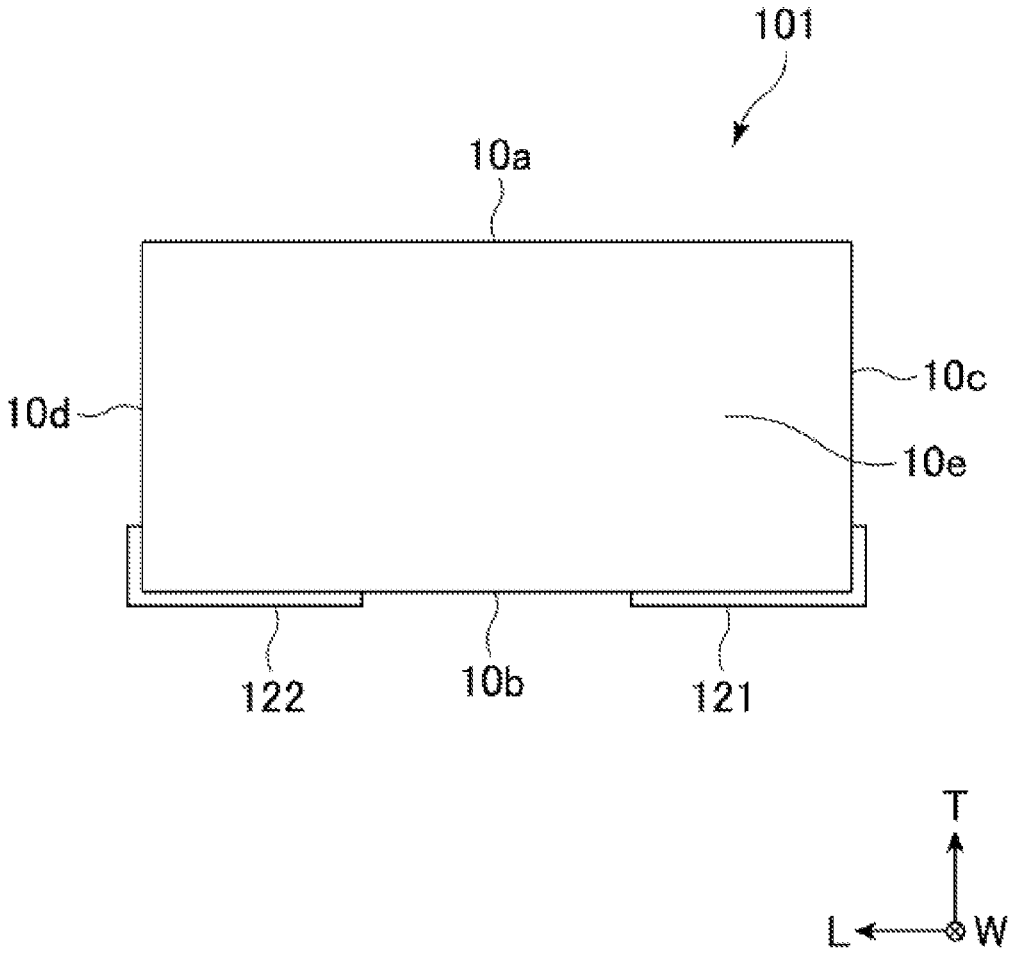
FIG. 7 is a front view of the coil component of FIG. 6.

As shown in FIGS. 6 and 7, the external electrode 121 of the coil component 101 extends from the mounting surface 10*b* to the end surface 10*c* of the base body 10. In other words, the external electrode 121 is attached to the mounting surface 10*b* and the end surface 10*c* of the base body 10. The external electrode 122 extends from the mounting surface 10*b* to the end surface 10*d* of the base body 10. In other words, the external electrode 122 is attached to the mounting surface 10*b* and the end surface 10*d* of the base body 10.

Figure 8:
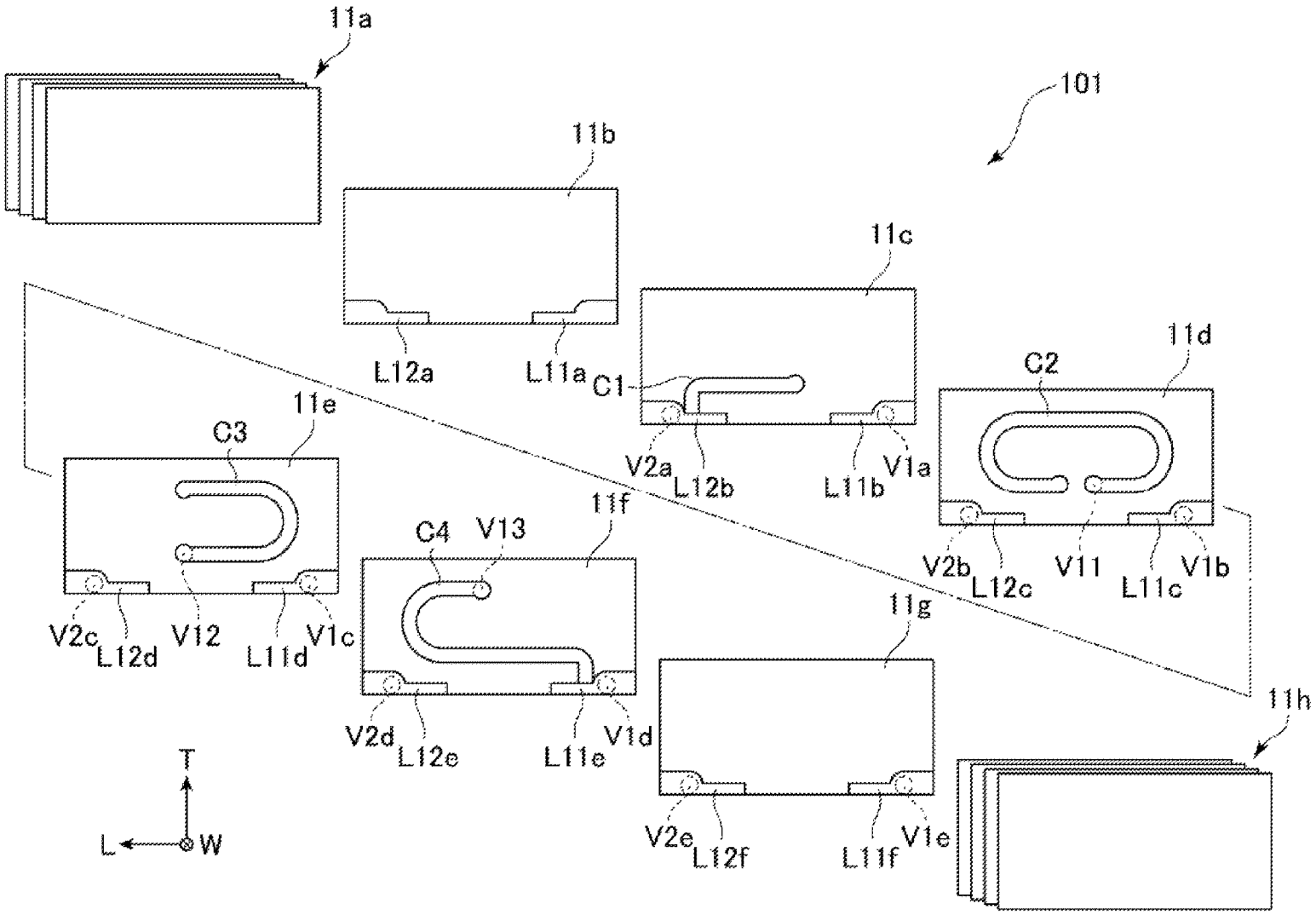
FIG. 8 is an exploded view of the coil component of FIG. 6.

The lead-out conductor 123 electrically connects between one end of the coil conductor 25 and the external electrode 121, and the lead-out conductor 124 electrically connects between the other end of the coil conductor 25 and the external electrode 122. As shown in FIG. 8, the lead-out conductor 123 includes the lead-out conductor patterns L11*a* to L11*f* and the vias Via to Vie, and the lead-out conductor 124 includes the lead-out conductor patterns L12*a* to L12*f* and the vias V2*a* to V2*e*. Adjacent ones of the lead-out conductor patterns L11*a* to L11*f* are electrically connected to each other through one of the vias Via to Vie, and adjacent ones of the lead-out conductor patterns L12*a* to L12*f* are electrically connected to each other through one of the vias V2*a* to V2*e*.

Figure 9:
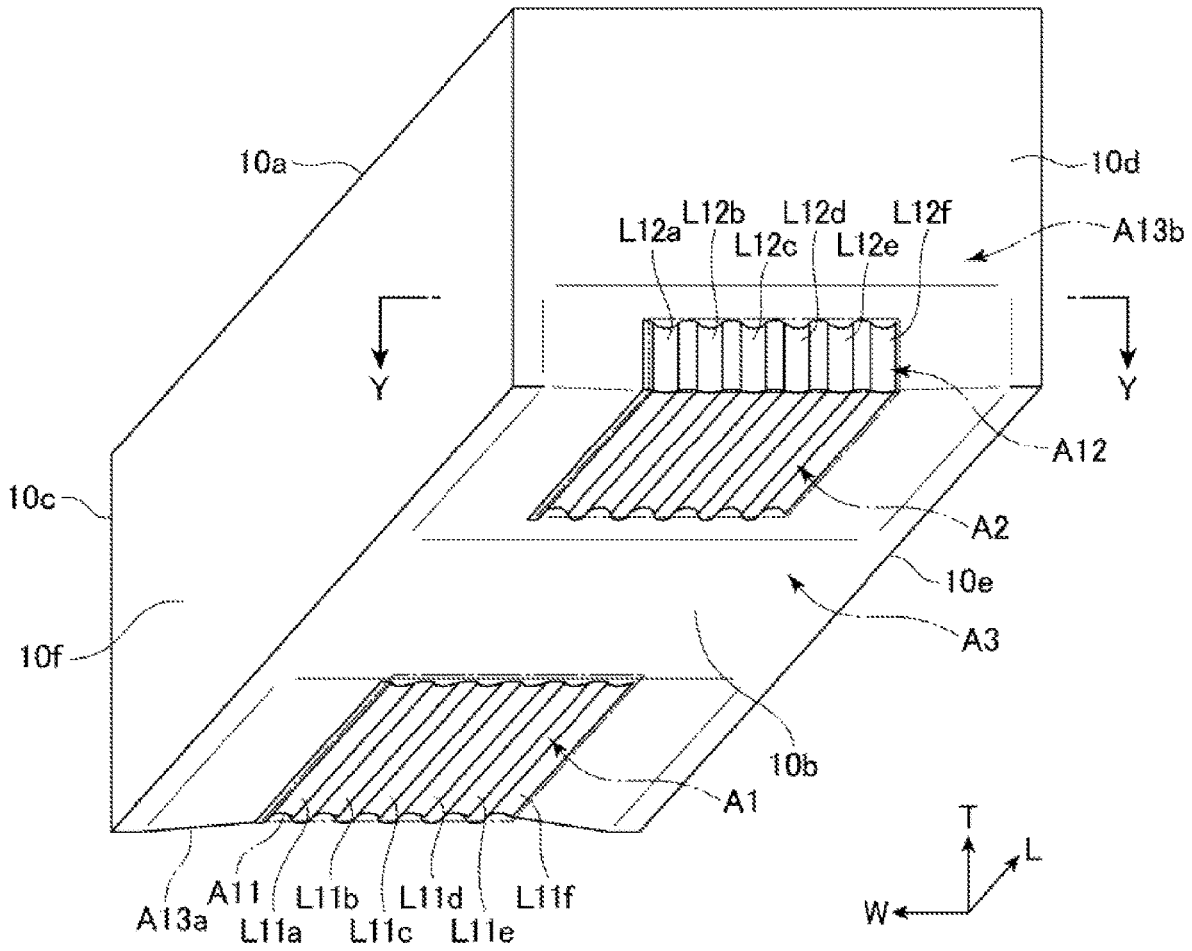
FIG. 9 is a perspective view of the coil component of FIG. 6 as viewed from a mounting surface side.

As shown in FIG. 9, the lead-out conductor patterns L12*a* to L12*f* are disposed so as to be exposed from the mounting surface 10*b* and the end surface 10*d* of the base body 10. Likewise, the lead-out conductor patterns L11*a* to L11*f* are disposed so as to be exposed from the mounting surface 10*b* and the end surface 10*c* of the base body 10. In FIG. 9, the end surface 10*c* is hidden behind, and therefore, the portions of the lead-out conductor patterns L11*a* to L11*f* that are exposed from the end surface 10*c* are not shown in FIG. 9.

The mounting surface 10*b* of the base body 10 includes a first exposure region A1 in which the lead-out conductor patterns L11*a* to L11*f* are exposed, a second exposure region A2 in which the lead-out conductor patterns L12*a* to L12*f* are exposed, and a non-exposure region A3 other than the first exposure region A1 and the second exposure region A2. The end surface 10*c* includes a third exposure region A11 in which the lead-out conductor patterns L11*a* to L11*f* are exposed and a non-exposure region A13*a* other than the third exposure region A11. The end surface 10*d* includes a fourth exposure region A12 in which the lead-out conductor patterns L12*a* to L12*f* are exposed and a non-exposure region A13*b* other than the fourth exposure region A12. The end of the first exposure region A1 on the negative side in the L axis direction is connected to the end of the third exposure region A11 on the negative side in the T axis direction. The end of the second exposure region A2 on the positive side in the L axis direction is connected to the end of the fourth exposure region A12 on the negative side in the T axis direction.

Figure 10:
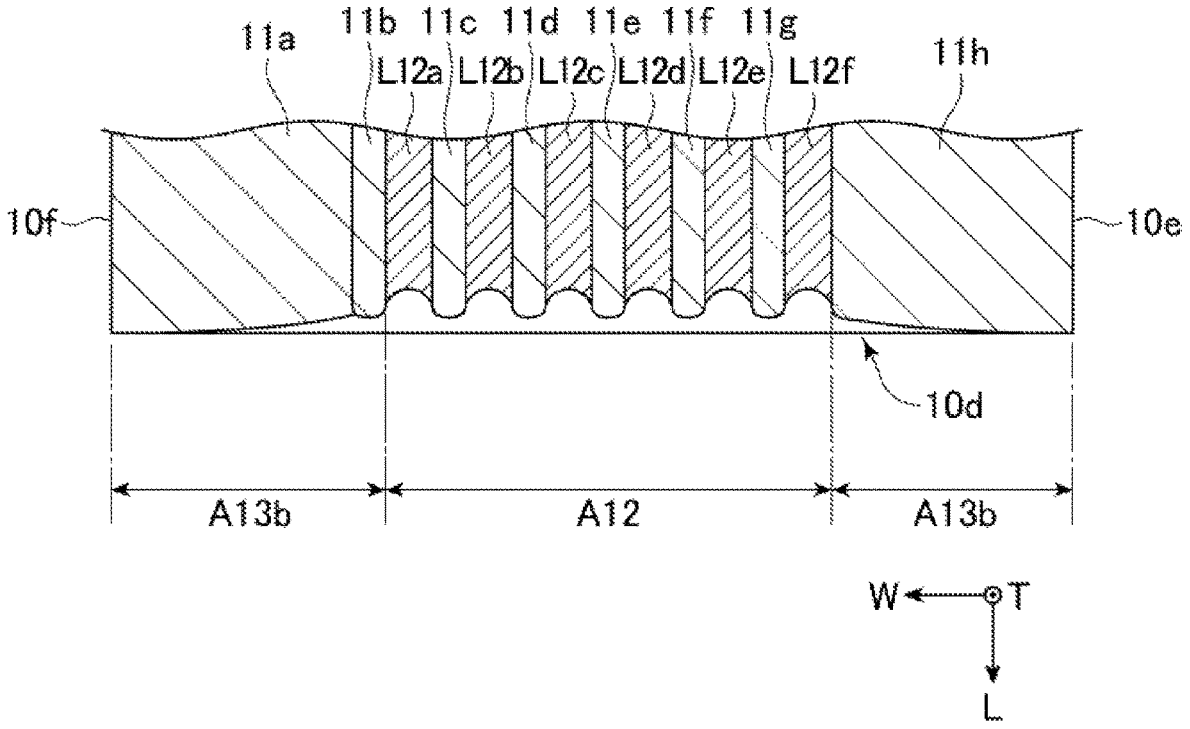
FIG. 10 schematically illustrates a part of a longitudinal section of the coil component of FIG. 6 cut along the line Y-Y.

Next, a description is given of the fourth exposure region A12 in the end surface 10*d* with reference to FIG. 10. FIG. 10 is a cross-sectional view of the coil component 101 cut along the line Y-Y. In other words, FIG. 10 shows a cross section of the coil component 101 cut along an LW plane extending through the fourth exposure region A12. In FIG. 10, the external electrode 122 is not shown for convenience of description.

As shown in FIG. 10, each of the lead-out conductor patterns L12*a* to L12*f* is disposed between adjacent two of the magnetic layers 11*b* to 11*h*. For example, the lead-out conductor pattern L12*b* is disposed between the magnetic layer 11*c* and the magnetic layer 11*d*. Likewise, the lead-out conductor pattern L12*a*, which is adjacent to the lead-out conductor pattern L12*b* and connected to the lead-out conductor pattern L12*b* through the via V2*a*, is disposed between the magnetic layer 11*b* and the magnetic layer 11*c*. The other lead-out conductor patterns included in the lead-out conductor patterns L12*a* to L12*f* are disposed in the same manner. Although not shown in FIG. 10, each of the lead-out conductor patterns L11*a* to L11*f* is also disposed between adjacent two of the magnetic layers 11*b* to 11*h*, in the same manner as the lead-out conductor patterns L12*a* to L12*f*.

As shown in FIG. 10, the lead-out conductor patterns L12*a* to L12*f* are disposed such that the respective end surfaces thereof are exposed from the end surface 10*d* in the fourth exposure region A12 of the end surface 10*d* of the base body 10. The external electrode 122 extends from the mounting surface 10*b* to the end surface 10*d*. Therefore, the external electrode 122 is disposed to contact with the end surfaces of the lead-out conductor patterns L12*a* to L12*f*. Although not shown, the lead-out conductor patterns L11*a* to L11*f* are disposed such that the respective end surfaces thereof are exposed from the end surface 10*c* in the third exposure region A11 of the end surface 10*c* of the base body 10. The external electrode 121 extends from the mounting surface 10*b* to the end surface 10*c*. Therefore, the external electrode 121 is disposed to contact with the end surfaces of the lead-out conductor patterns L11*a* to L11*f*.

As shown in FIG. 10, the magnetic layers 11*a* to 11*h* project from the end surfaces of the lead-out conductor patterns L12*a* to L12*f* toward the outside of the base body 10. In the embodiment shown, the magnetic layers 11*a* to 11*h* project from the end surfaces of the lead-out conductor patterns L12*a* to L12*f* in the positive direction of the L axis. In this way, the magnetic layers 11*b* to 11*g* project from the end surfaces of the lead-out conductor patterns L12*a* to L12*f* toward the outside of the base body 10, and therefore, the end surface 10*d* of the base body 10 has indentation in the fourth exposure region A12. Although not shown, the magnetic layers 11*a* to 11*h* project from the end surfaces of the lead-out conductor patterns L11*a* to L11*f* in the negative direction of the L axis. In this way, the magnetic layers 11*b* to 11*g* project from the end surfaces of the lead-out conductor patterns L11*a* to L11*f* toward the outside of the base body 10, and therefore, the end surface 10*c* of the base body 10 has indentation in the third exposure region A11.

The above description on the arrangement of the magnetic layers 11*a* to 11*h* and the lead-out conductor patterns L1*a* to L1*f* also applies to the arrangement of the magnetic layers 11*a* to 11*h* and the lead-out conductor patterns L11*a* to L11*f* and the arrangement of the magnetic layers 11*a* to 11*h* and the lead-out conductor patterns L12*a* to L12*f*.

Figure 11A:
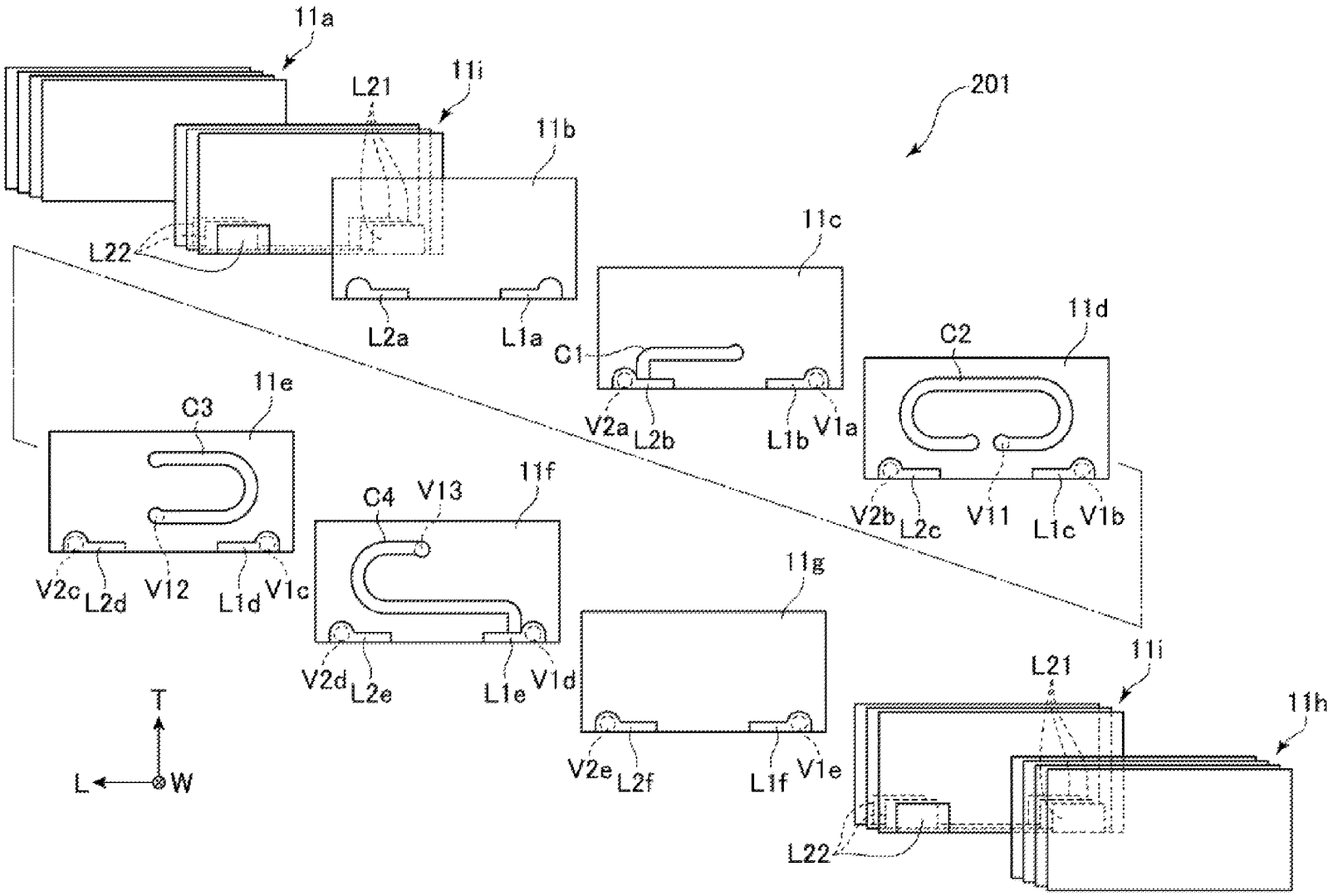
FIG. 11A is an exploded view of the coil component according to another embodiment of the invention.
Figure 11B:
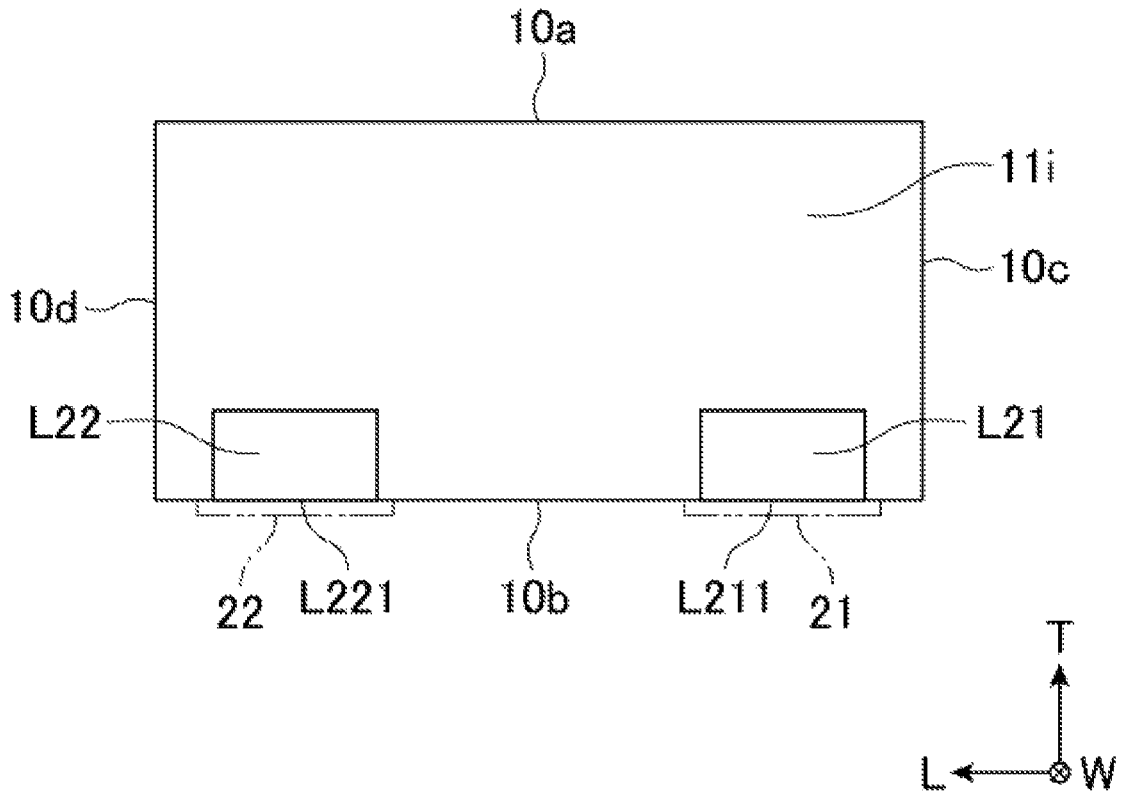
FIG. 11B schematically illustrates a magnetic layer and independent conductors included in the coil component of FIG. 11A.

Next, a coil component 201 according to another embodiment of the present invention will be described with reference to FIGS. 11A, 11B, and 12. As shown in FIG. 11B, the coil component 201 according to one embodiment of the present invention is different from the coil component 1 in that it includes a magnetic layer 11*i*, in addition to the magnetic layers 11*a* to 11*h*, and it further includes an independent conductor pattern L21 and an independent conductor pattern L22. In the example shown, the coil component 201 includes three magnetic layers between the magnetic layer 11*a* and the magnetic layer 11*b* and also includes three magnetic layers 11*i* between the magnetic layer 11*g* and the magnetic layer 11*h*. The magnetic layers 11*i* may be a part of the plurality of magnetic layers constituting the magnetic layer 11*a*, and the magnetic layers 11*i* may be a part of the plurality of magnetic layers constituting the magnetic layer 11*h*. The number of magnetic layers included in the coil component 201 is not limited to six. The coil component 201 according to one embodiment of the present invention may include only one magnetic layer 11*i* or include less or more than six magnetic layers 11*i*.

As shown in FIG. 11B, a magnetic layer 11*i* has an independent conductor pattern L21 and an independent conductor pattern L22 provided thereon. The independent conductor pattern L21 and the independent conductor pattern L22 are provided on one surface of the magnetic layer 11*i*. In the embodiment shown, the independent conductor pattern L21 and the independent conductor pattern L22 are provided on the surface on the negative side in the W axis direction among a pair of surfaces of the magnetic layer 11*i* intersecting the W axis direction. The independent conductor pattern L21 and the independent conductor pattern L22 are made of a conductive paste, as with the coil conductor patterns C1 to C4.

In the base body 10, the independent conductor pattern L21 and the independent conductor pattern L22 are spaced from the coil conductor 25, the first lead-out conductor 23, and the second lead-out conductor 24. In other words, the independent conductor pattern L21 and the independent conductor pattern L22 are disposed independently of the coil conductor 25, the first lead-out conductor 23, and the second lead-out conductor 24. Any adjacent two of the coil conductor patterns C1 to C4 constituting the coil conductor 25 are connected together through the vias V11 to V13, whereas the independent conductor pattern L21 and the independent conductor pattern L22 are connected to none of the conductor patterns constituting the coil conductor 25, the first lead-out conductor 23, and the second lead-out conductor 24 in the base body 10. When the coil component 201 includes a plurality of magnetic layers 11*i*, the independent conductor patterns provided on different magnetic layers 11*i* may be electrically connected to each other.

The end surface L211 of the independent conductor pattern L21 on the negative side in the T axis direction contacts with the external electrode 21. The external electrode 21 contacts directly with the lead-out conductor 23 and is electrically connected to the coil conductor 25 via the lead-out conductor 23, and therefore, the independent conductor pattern L21 is electrically connected to the lead-out conductor 23 and the coil conductor 25 via the external electrode 21, but in the base body 10, the independent conductor pattern L21 is spaced from the coil conductor 25 and the first lead-out conductor 23. Accordingly, the independent conductor pattern L21 is insulated from the coil conductor 25 and the first lead-out conductor 23 in the base body 10.

The end surface L221 of the independent conductor pattern L22 on the negative side in the T axis direction contacts with the external electrode 22. The independent conductor pattern L22 is electrically connected to the lead-out conductor 24 and the coil conductor 25 via the external electrode 22, but in the base body 10, the independent conductor pattern L22 is spaced from the coil conductor 25 and the second lead-out conductor 24. Accordingly, the independent conductor pattern L22 is insulated from the coil conductor 25 and the second lead-out conductor 24 in the base body 10.

In the base body 10, the independent conductor pattern L21 is spaced from the independent conductor pattern L22. Accordingly, the independent conductor pattern L21 is insulated from the independent conductor pattern L22 in the base body 10.

Any one of the independent conductor pattern L21 and the independent conductor pattern L22 can be omitted. In other words, the magnetic layer 11*i* has at least one of the independent conductor pattern L21 and the independent conductor pattern L22 provided thereon. The magnetic layer 11*i* may have another independent electrode (not shown), in addition to the independent conductor pattern L21 and the independent conductor pattern L22. Since the magnetic layer 11*i* has the independent conductor pattern L21 and the independent conductor pattern L22 provided thereon, the magnetic layer 11*i* may be herein referred to as an independent magnetic layer.

Figure 12:
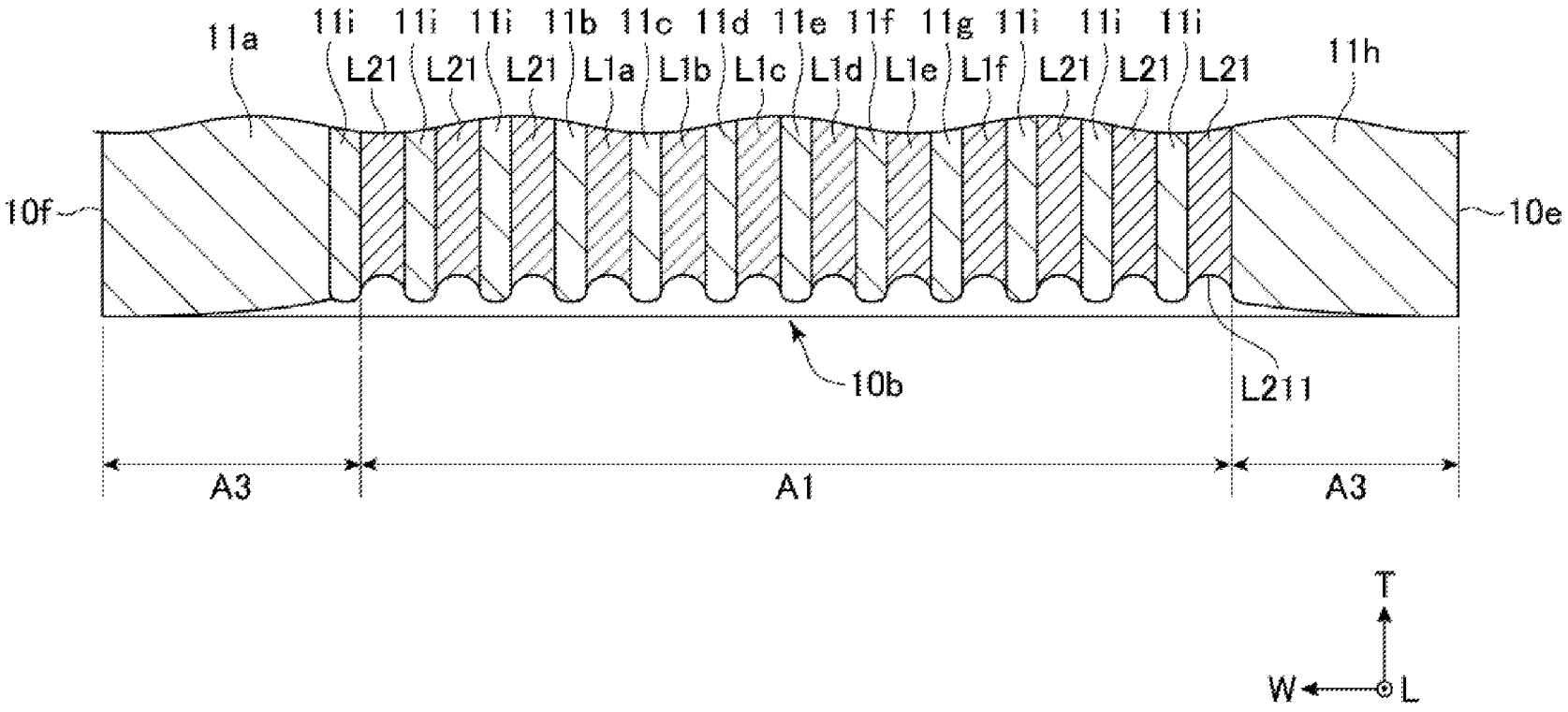
FIG. 12 schematically illustrates a cross section of the coil component of FIG. 11A cut along the line X-X.

A further description is given of the magnetic layer 11*i* with reference to FIG. 12. FIG. 12 schematically illustrates a part of a cross section of the coil component including the magnetic layers 11*i*, the cross section being cut along the line X-X mentioned above. In FIG. 12, the external electrode 21 is not shown for convenience of description. In the embodiment shown in FIG. 12, the magnetic layers 11*i* are disposed between the magnetic layer 11*g* and the magnetic layer 11*h*. The illustrated arrangement of the magnetic layers 11*i* is an example, and the magnetic layers 11*i* may be disposed other positions.

As shown, the independent conductor patterns L21 are disposed between the magnetic layers 11*i* and the magnetic layer 11*h*. Any adjacent two of the lead-out conductor patterns L1*a* to L1*f* are connected together through the vias V1*a* to V1*e* in the base body 10, whereas the independent conductor patterns L21 are connected to none of the lead-out conductor patterns L1*a* to L1*f* in the base body 10. The independent conductor patterns L21 are disposed such that the end surfaces L211 thereof are exposed from the first exposure region A1 of the mounting surface 10*b* of the base body 10. Since the external electrode 21 is disposed on the mounting surface 10*b*, the external electrode 21 is disposed to contact with the end surfaces L211 of the independent conductor patterns L21. Although not shown, the independent conductor patterns L22 are disposed such that the end surfaces thereof are exposed from the mounting surface 10*b* in the second exposure region A2 of the mounting surface 10*b* of the base body 10. The external electrode 22 is disposed on the mounting surface 10*b*. Therefore, the external electrode 22 is disposed to contact with the end surfaces of the independent conductor patterns L22. In the coil component 201, the region of the mounting surface 10*b* in which the lead-out conductor patterns L1*a* to L1*f* and the independent conductor patterns L21 are exposed is the first exposure region A1, and the region of the mounting surface 10*b* in which the lead-out conductor patterns L2*a* to L2*f* and the independent conductor patterns L22 are exposed is the second exposure region A2.

As shown in FIG. 12, the magnetic layer 11*h* and the magnetic layers project from the end surfaces L211 of the independent conductor patterns L21 toward the outside of the base body 10. In this way, the magnetic layer 11*h* and the magnetic layers 11*i* project from the end surfaces L211 of the independent conductor patterns L21 toward the outside of the base body 10, and therefore, indentation is formed in the region of the mounting surface 10*b* in which the independent conductor pattern L21, the magnetic layer 11*h*, and the magnetic layers 11*i* are disposed.

FIG. 11B shows that the independent conductor pattern L21 and the independent conductor pattern L22 have a rectangular shape as viewed from the W axis direction, but the shape of the independent conductor pattern L21 and the independent conductor pattern L22 are not limited to that shown in the drawing. The independent conductor pattern L21 can be disposed at any position on the magnetic layer 11*i* where the independent conductor pattern L21 is exposed from the mounting surface 10*b* to contact with the external electrode 21. Likewise, the independent conductor pattern L22 can be disposed at any position on the magnetic layer 11*i* where the independent conductor pattern L22 is exposed from the mounting surface 10*b* to contact with the external electrode 22. In one embodiment, the dimension of the independent conductor pattern L21 in the L axis direction parallel to the external electrode 21 is larger than the dimension thereof in the T axis direction perpendicular to the external electrode 21.

Figure 13A:
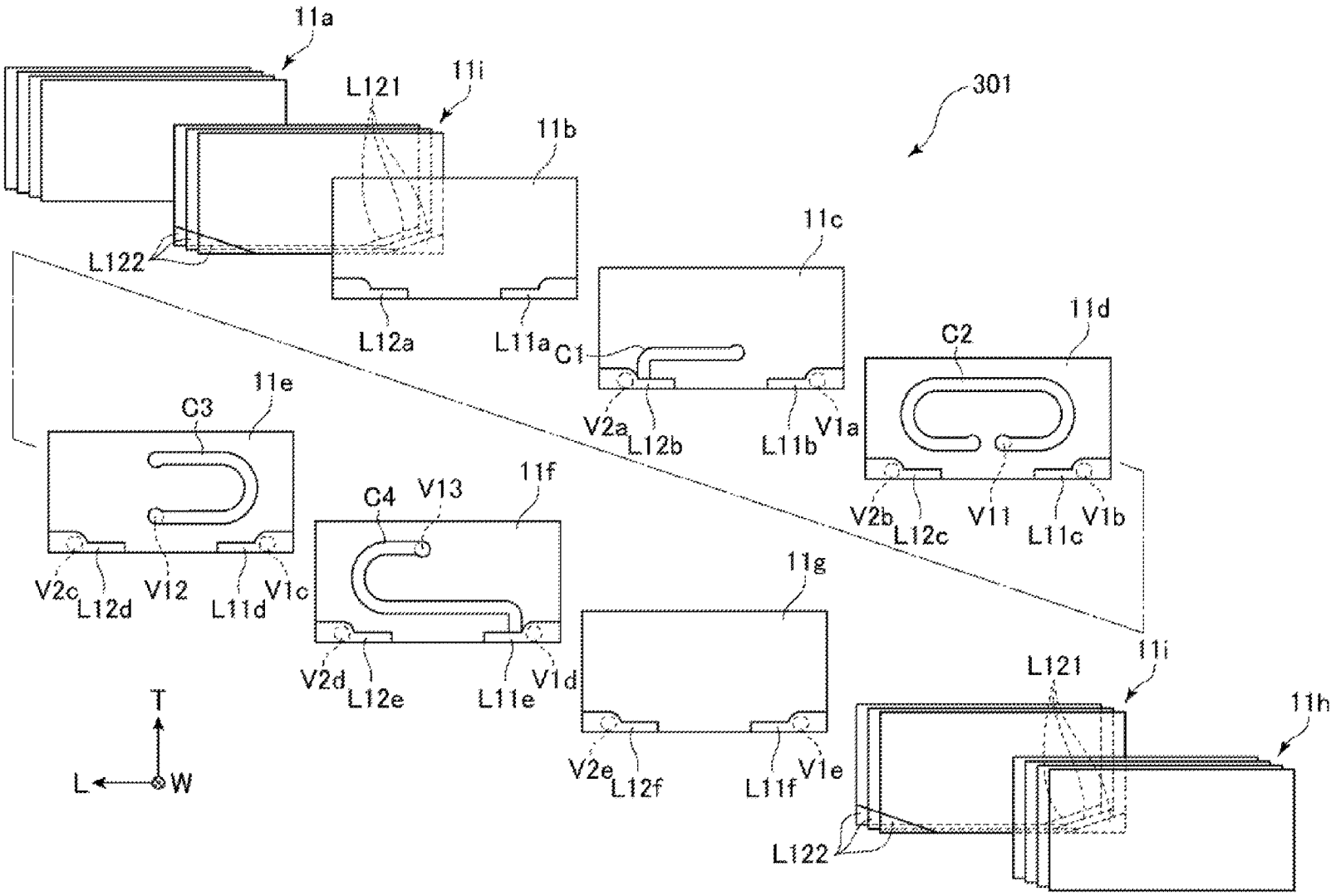
FIG. 13A is an exploded view of the coil component according to another embodiment of the invention.
Figure 13B:
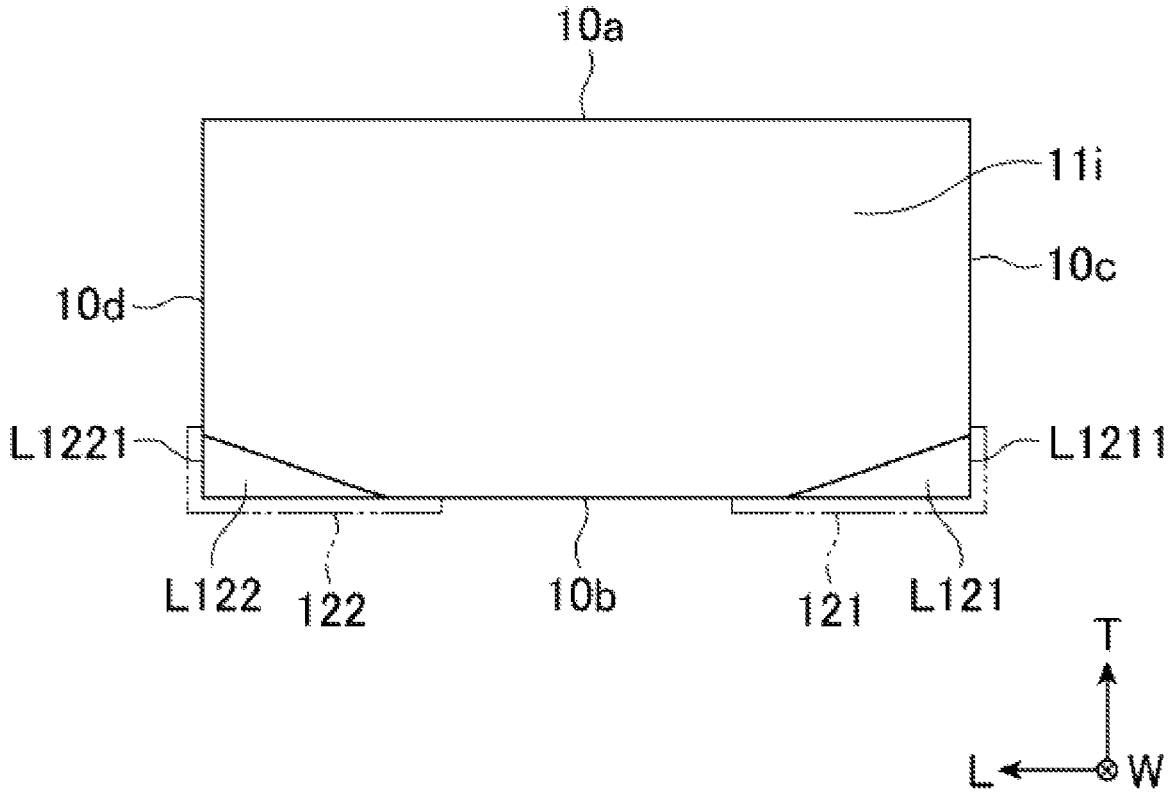
FIG. 13B schematically illustrates a magnetic layer and independent conductors included in the coil component of FIG. 13A.

Next, a coil component 301 according to another embodiment of the present invention will be described with reference to FIGS. 13A, 13B, and 14. As shown in FIG. 13B, the coil component 301 according to one embodiment of the present invention is different from the coil component 101 in that it includes a magnetic layer 11*i*, in addition to the magnetic layers 11*a* to 11*h*, and it further includes an independent conductor pattern L121 and an independent conductor patterns L122. In the example shown, the coil component 301 includes three magnetic layers 11*i* between the magnetic layer 11*a* and the magnetic layer 11*b* and also includes three magnetic layers 11*i* between the magnetic layer 11*g* and the magnetic layer 11*h*. The number of magnetic layers 11*i* included in the coil component 301 is not limited to six. The coil component 301 according to one embodiment of the present invention may include only one magnetic layer 11*i* or include less or more than six magnetic layers 11*i*.

The independent conductor pattern L121 and the independent conductor pattern L122 are different from the independent conductor pattern L21 and the independent conductor pattern L22 in that the independent conductor patterns L121 and L122 are disposed to be exposed also from the end surface 10*c* for connection with the external electrode 121 and the external electrode 122. The independent conductor pattern L121 is configured and disposed in the same manner as the independent conductor pattern L21 except that it is exposed from the end surface 10*c* to be connected to the external electrode 121. The independent conductor pattern L122 is configured and disposed in the same manner as the independent conductor pattern L22 except that it is exposed from the end surface 10*d* and connected to the external electrode 122.

Figure 14:
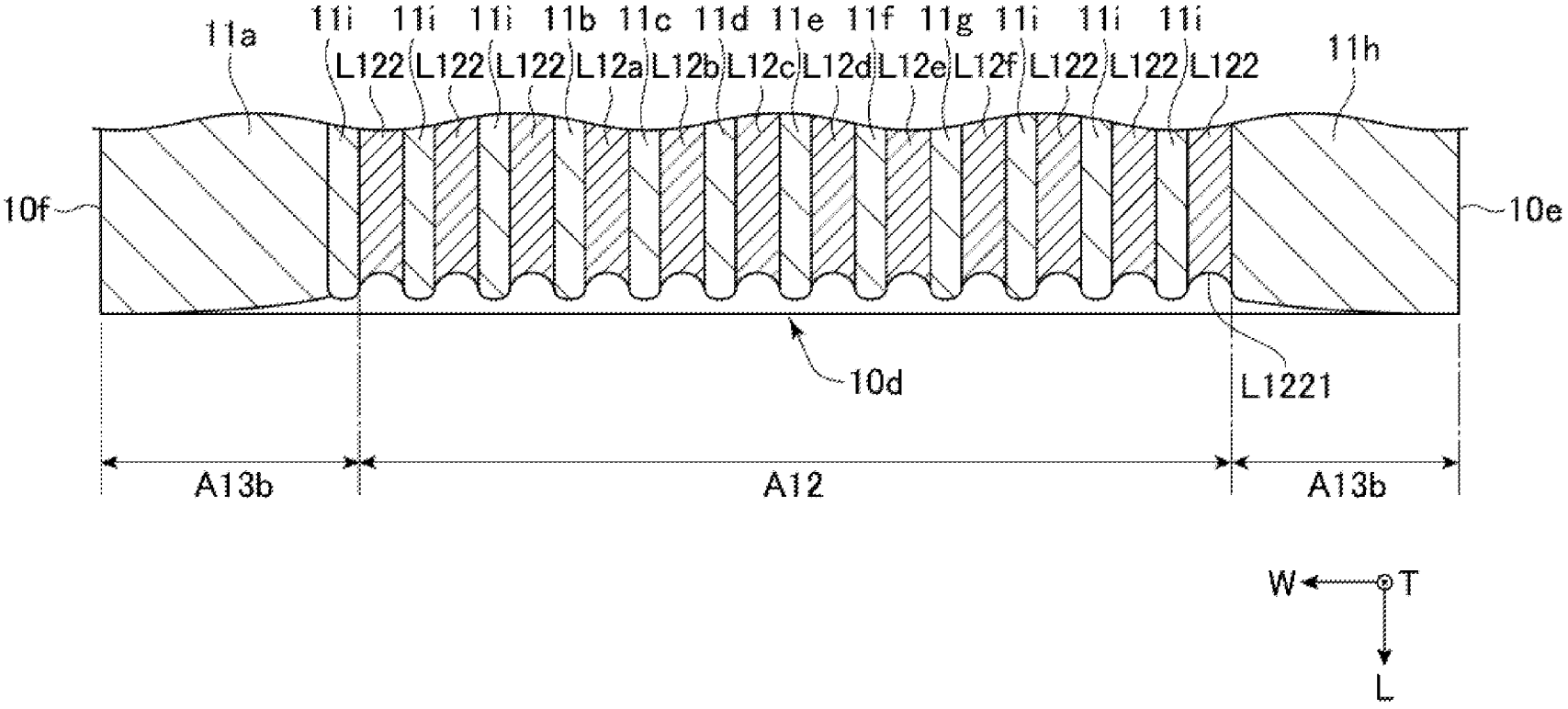
FIG. 14 schematically illustrates a longitudinal section of the coil component of FIG. 13A cut along the line X-X.

As shown in FIG. 14, the magnetic layer 11*h* and the magnetic layers project from the end surfaces L1221 of the independent conductor patterns L122 toward the outside of the base body 10. In this way, the magnetic layer 11*h* and the magnetic layers 11*i* project from the end surfaces L1221 of the independent conductor patterns L122 toward the outside of the base body 10, and therefore, indentation is formed in the region of the end surface 10*d* in which the independent conductor pattern L122, the magnetic layer 11*h*, and the magnetic layers 11*i* are disposed. Likewise, indentation is also formed in the region of the end surface 10*c* in which the independent conductor pattern L121, the magnetic layer 11*h*, and the magnetic layers 11*i* are disposed. In the coil component 301, the region of the end surface 10*c* in which the lead-out conductor patterns L11*a* to L11*f* and the independent conductor patterns L121 are exposed is the third exposure region A11, and the region of the end surface 10*d* in which the lead-out conductor patterns L12*a* to L12*f* and the independent conductor patterns L122 are exposed is the fourth exposure region A12.

Advantageous effects of the above embodiments will now be described. According to one of the embodiments described above, the magnetic layers 11*a* to 11*h* project from the lead-out conductor patterns L1*a* to L1*f* toward the outside of the base body 10, and therefore, the mounting surface 10*b* of the base body 10 has indentation in the first exposure region A1. The external electrode 21 is attached to the base body 10 and the lead-out conductor 23 at the indented surface. The indentation in the first exposure region A1 enlarges the contact area in which the external electrode 21 contacts with the base body 10 and the lead-out conductor 23, thereby securing the attachment of the external electrode 21 to the base body 10 and the lead-out conductor 23. This inhibits the external electrode 21 from falling off the base body 10.

According to the above embodiment, the magnetic layers 11*a* to 11*h* project from the lead-out conductor patterns L2*a* to L2*f* toward the outside of the base body 10, and therefore, the mounting surface 10*b* of the base body 10 has indentation in the second exposure region A2. The external electrode 22 is attached to the base body 10 and the lead-out conductor 24 at the indented surface. The indentation in the second exposure region A2 enlarges the contact area in which the external electrode 22 contacts with the base body 10 and the lead-out conductor 24, thereby securing the attachment of the external electrode 22 to the base body 10 and the lead-out conductor 24. This inhibits the external electrode 22 from falling off the base body 10.

According to the above embodiment, the mounting surface 10*b* of the base body 10 includes the first exposure region A1, the second exposure region A2, and the non-exposure region A3, and the non-exposure region A3 projects from the first exposure region A1 and the second exposure region A2 toward the outside of the base body 10. In other words, in the mounting surface 10*b*, the first exposure region A1 and the second exposure region A2 are concaved from the non-exposure region A3 toward the inside of the base body 10. When the coil component 1 is mounted on the circuit board 2, a larger amount of solder can be received in the first exposure region A1 and the second exposure region A2 than in the case where the mounting surface 10*b* is flat. This increases the joint strength between the coil component 1 and the circuit board 2.

The above advantageous effects of the coil component 1 can also be produced by the coil component 101.

In the coil component 101 according to one of the embodiments described above, the magnetic layers 11*a* to 11*h* project from the lead-out conductor patterns L11*a* to L11*f* and the lead-out conductor patterns L12*a* to L12*f* toward the outside of the base body 10, and therefore, the end surface 10*c* of the base body 10 has indentation in the third exposure region A11, and the end surface 10*d* of the base body 10 has indentation in the fourth exposure region A12. The external electrode 121 is attached to the base body 10 and the lead-out conductor 123 at the indented surface of the third exposure region A11, in addition to the indented surface of the first exposure region A1 of the mounting surface 10*b*. This arrangement further enlarges the contact area in which the external electrode 121 contacts with the base body 10 and the lead-out conductor 123, thereby further securing the attachment of the external electrode 121 to the base body 10 and the lead-out conductor 123. Likewise, the external electrode 122 is attached to the base body 10 and the lead-out conductor 124 at the indented surface of the fourth exposure region A12, in addition to the indented surface of the second exposure region A2 of the mounting surface 10*b*. This arrangement further enlarges the contact area in which the external electrode 122 contacts with the base body 10 and the lead-out conductor 124, thereby further securing the attachment of the external electrode 122 to the base body 10 and the lead-out conductor 124.

According to one of the embodiments described above, the independent conductor pattern L21 is disposed between the magnetic layer 11*i* and the magnetic layer 11*h*, and both the magnetic layer 11*i* and the magnetic layer 11*h* project from the independent conductor pattern L21 toward the outside of the base body 10, thereby increasing the proportion of first exposure region A1 having the indented surface in the mounting surface 10*b*. This arrangement enlarges the contact area in which the external electrode 21 contacts with the base body 10, the lead-out conductor 23, and the independent conductor pattern L21, thereby further securing the attachment of the external electrode 21 to the base body 10. Likewise, according to the above embodiment, both the magnetic layer 11*i* and the magnetic layer 11*h* project from the independent conductor pattern L22 toward the outside of the base body 10, thereby increasing the proportion of the second exposure region A2 in the mounting surface 10*b*. This arrangement further secures the attachment of the external electrode 22 to the base body 10.

According to one of the embodiments described above, the independent conductor pattern L121 is disposed between the magnetic layer 11*i* and the magnetic layer 11*h*, and both the magnetic layer 11*i* and the magnetic layer 11*h* project from the independent conductor pattern L121 toward the outside of the base body 10, thereby increasing the proportion of the third exposure region A11 having the indented surface in the end surface 10*c*. This arrangement enlarges the contact area in which the external electrode 121 contacts with the base body 10, the lead-out conductor 123, and the independent conductor pattern L121, thereby further securing the attachment of the external electrode 121 to the base body 10. Likewise, according to the above embodiment, both the magnetic layer 11*i* and the magnetic layer 11*h* project from the independent conductor pattern L122 toward the outside of the base body 10, thereby increasing the proportion of the fourth exposure region A12 in the end surface 10*d*. This arrangement further secures the attachment of the external electrode 122 to the base body 10.

In one embodiment, the dimension of the independent conductor pattern L21 in the L axis direction parallel to the external electrode 21 is larger than the dimension thereof in the T axis direction perpendicular to the external electrode 21. As the dimension of the independent conductor pattern L21 in the T axis direction is larger, more interference occurs in the magnetic path of the magnetic flux passing through the base body 10. On the other hand, a larger dimension of the independent conductor pattern L21 in the T axis direction does not increase the fixing strength of the external electrode 21. In view of the above, when the dimension of the independent conductor pattern L21 in the L axis direction parallel to the external electrode 21 is larger than the dimension thereof in the T axis direction perpendicular to the external electrode 21, the external electrode 21 can be fixed firmly with no major impact on the magnetic characteristics of the coil component 1.

The dimensions, materials, and arrangements of the constituent elements described herein are not limited to those explicitly described for the embodiments, and these constituent elements can be modified to have any dimensions, materials, and arrangements within the scope of the present invention. Furthermore, constituent elements not explicitly described herein can also be added to the described embodiments, and it is also possible to omit some of the constituent elements described for the embodiments.

For example, the shapes and the arrangements of the external electrodes 21, 22, 121, and 122 are mere examples. The external electrodes 21, 22, 121, and 122 can be modified as appropriate. For example, at least one of the external electrodes 21, 22, 121, and 122 may contact with at least one of the first side surface 10*e*, the second side surface 10*f*, and the first principal surface 10*a* of the base body 10. When contacting with any one of the first side surface 10*e*, the second side surface 10*f*, and the first principal surface 10*a*, the external electrodes 21, 22, 121, and 122 can be attached to the base body 10 more firmly.

What is claimed is:

1. A coil component comprising:

a base body having a plurality of magnetic layers including a first magnetic layer, a second magnetic layer, and a third magnetic layer;

a first external electrode provided on a surface of the base body;

a second external electrode provided on the surface of the base body, the second external electrode being spaced from the first external electrode;

a coil conductor provided in the base body;

a first lead-out conductor including a first lead-out conductor first pattern and a first lead-out conductor second pattern, the first lead-out conductor first pattern being provided between the first magnetic layer and the second magnetic layer so as to be connected to a first end of the coil conductor and the first external electrode, the first lead-out conductor second pattern being provided between the second magnetic layer and the third magnetic layer so as to be connected to the first lead-out conductor first pattern and the first external electrode; and a second lead-out conductor connecting a second end of the coil conductor and the second external electrode, wherein the first magnetic layer, the second magnetic layer, and the third magnetic layer project from a first contact surface and a second contact surface toward an outside of the base body, the first contact surface being a surface at which the first external electrode and the first lead-out conductor first pattern contact with each other, the second contact surface being a surface at which the first external electrode and the first lead-out conductor second pattern contact with each other.

2. The coil component of claim 1, wherein the plurality of magnetic layers further include a fourth magnetic layer, a fifth magnetic layer, and a sixth magnetic layer, wherein the second lead-out conductor includes a second lead-out conductor first pattern and a second lead-out conductor second pattern, the second lead-out conductor first pattern being provided between the fourth magnetic layer and the fifth magnetic layer so as to be connected to the second end of the coil conductor and the second external electrode, the second lead-out conductor second pattern being provided between the fifth magnetic layer and the sixth magnetic layer so as to be connected to the second lead-out conductor first pattern and the second external electrode, and wherein the fourth magnetic layer, the fifth magnetic layer, and the sixth magnetic layer project from a third contact surface and a fourth contact surface toward the outside of the base body, the third contact surface being a surface at which the second external electrode and the second lead-out conductor first pattern contact with each other, the fourth contact surface being a surface at which the second external electrode and the second lead-out conductor second pattern contact with each other.

3. The coil component of claim 1, wherein the surface of the base body includes a first region and a second region, the first region being a region in which the first lead-out conductor is exposed, the second region projecting from the first region toward the outside of the base body, and wherein the first external electrode is provided on the surface so as to cover at least a part of the first region.

4. The coil component of claim 3, wherein the first external electrode is provided on the surface so as to cover at least a part of the first region and at least a part of the second region.

5. The coil component of claim 3, wherein the first external electrode and the second external electrode are connected to a circuit board, wherein the surface of the base body includes a mounting surface facing the circuit board, and wherein the first region and the second region are regions in the mounting surface.

6. The coil component of claim 5, wherein the surface of the base body includes a first end surface and a second end surface both connected to the mounting surface, wherein the first end surface includes a third region in which the first lead-out conductor is exposed, wherein the second end surface includes a fourth region in which the second lead-out conductor is exposed, wherein the first external electrode is provided on the surface so as to further cover at least a part of the third region, and wherein the second external electrode is provided on the surface so as to further cover at least a part of the fourth region.

7. The coil component of claim 1, wherein a thickness of each of the first magnetic layer, the second magnetic layer, and the third magnetic layer is smaller than a thickness of the first lead-out conductor first pattern and a thickness of the first lead-out conductor second pattern.

8. The coil component of claim 1, further comprising a first independent conductor disposed in the base body so as to be spaced from the coil conductor, the first lead-out conductor, and the second lead-out conductor, the first independent conductor contacting with the first external electrode at a fifth contact surface, wherein the first independent conductor is provided on a first independent magnetic layer included in the plurality of magnetic layers, the first independent magnetic layer being different from the first magnetic layer, the second magnetic layer, and the third magnetic layer, and wherein the first independent magnetic layer projects from the fifth contact surface toward the outside of the base body.

9. The coil component of claim 8, further comprising a second independent conductor disposed in the base body so as to be spaced from the coil conductor, the first lead-out conductor, and the second lead-out conductor, the second independent conductor contacting with the second external electrode at a sixth contact surface, wherein the second independent conductor is provided on the first independent magnetic layer, and wherein the first independent magnetic layer projects from the sixth contact surface toward the outside of the base body.

10. A circuit board comprising the coil component of claim 1.

11. An electronic device comprising the circuit board according to claim 10.

* * * * *